US005529642A

United States Patent [19]

Sugahara et al.

[11] Patent Number: 5,529,642

[45] Date of Patent: Jun. 25, 1996

[54] NICKEL-BASED ALLOY WITH CHROMIUM, MOLYBDENUM AND TANTALUM

[75] Inventors: Katsuo Sugahara; Hideo Kitamura; Saburo Wakita; Koji Toyokura; Yoshio Takizawa, all of Omiya; Tsutomu Takahashi, Iwaki, all of Japan

[73] Assignee: Mitsubishi Materials Corporation, Tokyo, Japan

[21] Appl. No.: 308,424

[22] Filed: Sep. 19, 1994

[30] Foreign Application Priority Data

| | | | |
|---|---|---|---|
| Sep. 20, 1993 | [JP] | Japan | 5-256360 |
| May 25, 1994 | [JP] | Japan | 6-135079 |
| Jun. 17, 1994 | [JP] | Japan | 6-159097 |

[51] Int. Cl.[6] ..... C22C 19/07

[52] U.S. Cl. ..... 148/427; 148/428; 420/442; 420/443; 420/444; 420/445; 420/448; 420/449; 420/450; 420/453; 420/454

[58] Field of Search ..... 148/410, 428, 148/427; 420/443, 442, 444, 450, 448, 445, 451, 447, 453, 454

[56] References Cited

U.S. PATENT DOCUMENTS

| | | | |
|---|---|---|---|
| 3,160,500 | 12/1964 | Eiselstein et al. . | |
| 3,203,792 | 8/1965 | Scheil . | |
| 4,118,223 | 10/1978 | Acuncius et al. | 420/443 |
| 4,210,447 | 7/1980 | Tsai | 420/443 |
| 4,283,234 | 8/1981 | Fukui et al. | 420/442 |
| 4,400,211 | 8/1983 | Kudo et al. | 420/443 |
| 4,533,414 | 8/1985 | Asphahani . | |
| 4,719,080 | 1/1988 | Duhl et al. | 420/448 |
| 4,906,437 | 3/1990 | Heubner et al. | 420/443 |
| 5,000,914 | 3/1991 | Igarashi et al. | 420/448 |
| 5,077,141 | 12/1991 | Naik et al. | 420/448 |
| 5,120,614 | 6/1992 | Hibner et al. | 420/448 |
| 5,217,684 | 6/1993 | Igarashi et al. | 420/448 |
| 5,417,918 | 5/1995 | Köhler | 420/443 |

FOREIGN PATENT DOCUMENTS

| | | | |
|---|---|---|---|
| 0424277 | 4/1991 | European Pat. Off. . | |
| 2049528 | 3/1971 | France . | |
| 2519744 | 4/1976 | Germany . | |
| 62-40337 | 2/1987 | Japan . | |
| 62-158847 | 7/1987 | Japan | C22C 19/05 |
| 62-158849 | 7/1987 | Japan | C22C 19/05 |
| 62-158846 | 7/1987 | Japan | C22C 19/05 |
| 62-158845 | 7/1987 | Japan | C22C 19/05 |
| 62-158844 | 7/1987 | Japan | C22C 19/05 |
| 05-255784 | 10/1993 | Japan | C22C 19/05 |
| 2038359 | 7/1980 | United Kingdom . | |
| 2102834 | 2/1983 | United Kingdom . | |

OTHER PUBLICATIONS

JPO Abs of 62–158,848 1987.
JPO Abs of 62–158,844 1987.
Database WPI, Derwent Publications, AN–88–102566 and JP–63–53233, Mar. 7, 1988.

*Primary Examiner*—David A. Simmons
*Assistant Examiner*—Margery S. Phipps
*Attorney, Agent, or Firm*—Oblon, Spivak, McClelland, Maier & Neustadt

[57] ABSTRACT

A nickel-based alloy which is excellent not only in anti-corrosion properties but also in workability is disclosed. The alloy contains 15 to 35 weight % of chromium; 6 to 24 weight % of molybdenum; wherein the sum of chromium plus molybdenum is no greater than 43 weight %; 1.1 to 8 weight % of tantalum; and balance nickel and unavoidable impurities. The alloy may optionally include no greater than 0.1 weight % of nitrogen; no greater than 0.3 weight % of magnesium, no greater than 3 weight % of manganese, no greater than 0.3 weight % of silicon, no greater than 0.1 weight % of carbon, no greater than 6 weight % of iron, no greater than 0.1 weight % of zirconium, no greater than 0.01 weight % of calcium, no greater than 1 weight % of niobium, no greater than 4 weight % of tungsten, no greater than 4 weight % of copper, no greater than 0.8 weight % of titanium, no greater than 0.8 weight % of aluminum, no greater than 5 weight % of cobalt, no greater than 0.5 weight % of vanadium, no greater than 2 weight % of hafnium, no greater than 3 weight % of rhenium, no greater than 1 weight % of osmium, no greater than 1 weight % of platinum, no greater than 1 weight % of ruthenium, no greater than 1 weight % of palladium, no greater than 0.1 weight % of lanthanum, no greater than 0.1 weight % of cerium, or no greater than 0.1 weight % of yttrium.

13 Claims, 1 Drawing Sheet

NICKEL-BASED ALLOY WITH CHROMIUM, MOLYBDENUM AND TANTALUM

BACKGROUND OF THE INVENTION

1. Field of the Invention

This invention relates to a Ni-based alloy which is excellent in anti-corrosion properties, in particular anti-pitting corrosion property and anti-crevice corrosion property in an environment containing chlorine ions, as well as in workability, in particular workability in hot working.

2. Conventional Art

Ni-based alloys having excellent anti-corrosion properties have hitherto been used in the manufacture of exhaust gas desulfurizers for chemical plants, electroplating devices, boilers or the like; structural members for semiconductor devices; food processing devices; medical equipment; and various cutter blades and manual tools which are exposed to sea water; or the like.

Ni-based alloys conventionally known as such anti-corrosive alloys include a Ni-based alloy (hereinafter referred to as "alloy 55C") disclosed in Japanese Patent Application, Laid-Open (First-Publication) No. 62-40337, and consisting of 30.1 weight % of Cr, 20.3 weight % of Mo, balance Ni and unavoidable impurities; a Ni-based alloy (hereinafter referred to as "alloy 625") disclosed in U.S. Pat. No. 3,160,500 and consisting of 21.5 weight % of Cr, 9 weight % of Mo, 2.5 weight % of Fe, 3.7 weight % of Nb, balance Ni and unavoidable impurities; a Ni-based alloy (hereinafter referred to as "alloy C-276") disclosed in U.S. Pat. No. 3,203,792 and consisting of 16.1 weight % of Cr, 16.2 weight % of Mo, 5.2 weight % of Fe, 3.2 weight % of W, balance Ni and unavoidable impurities; and a Ni-based alloy (hereinafter referred to as "alloy C-22") disclosed in U.S. Pat. No. 4,533,414 and consisting of 21.5 weight % of Cr, 13.2 weight % of Mo, 4.1 weight % of Fe, 3.1 weight % of W, balance Ni and unavoidable impurities.

However, the demands for the anti-corrosive Ni-based alloys having more excellent anti-corrosion properties and workability have been increasing because anti-corrosive Ni alloys are being utilized in progressively severe environments in recent years, and because the devices employed in such environments have come to have more complicated shapes. The aforesaid conventional Ni-based alloys are therefore not satisfactory. More specifically, "alloy 625", "alloy C-276" and "alloy C-22" exhibit excellent workability in hot working, but are inferior in anti-corrosion properties, in particular anti-pitting corrosion property and anti-crevice corrosion property in an environment containing chlorine ions. In contrast, "alloy 55C" exhibits excellent anti-corrosion properties in the environment containing chlorine ions, but is inferior in workability in hot working operation.

SUMMARY OF THE INVENTION

It is therefore a primary object of the present invention to provide a Ni-based alloy which is excellent not only in anti-corrosion properties but also in workability.

Another object of the invention is to provide a Ni-based alloy which exhibits superior corrosion resistance in particular in the environment in which chlorine ions are contained.

Yet another object of the invention is to provide a Ni-based alloy which is resistant to acids such as hydrochloric acid, hydrofluoric acid, oxalic acid, phosphoric acid, or nitric acid; alkalis such as sodium hydroxide; and sea water which is neutral.

A further object of the invention is to provide a Ni-based alloy which is particularly resistant to a variety of sulfuric acid corrosion.

According to the present invention, there is provided a Ni-based alloy consisting of:

15 to 35 weight % of chromium;

6 to 24 weight % of molybdenum;

wherein the sum of chromium plus molybdenum is no greater than 43 weight %;

1.1 to 8 weight % of tantalum;

optionally, no greater than 0.1 weight % of nitrogen; no greater than 0.3 weight % of magnesium, no greater than 3 weight % of manganese, no greater than 0.3 weight % of silicon, no greater than 0.1 weight % of carbon, no greater than 6 weight % of iron, no greater than 0.1 weight % of boron, no greater than 0.1 weight % of zirconium, no greater than 0.01 weight % of calcium, no greater than 1 weight % of niobium, no greater than 4 weight % of tungsten, no greater than 4 weight % of copper, no greater than 0.8 weight % of titanium, no greater than 0.8 weight % of aluminum, no greater than 5 weight % of cobalt, no greater than 0.5 weight % of vanadium, no greater than 2 weight % of hafnium, no greater than 3 weight % of rhenium, no greater than 1 weight % of osmium, no greater than 1 weight % of platinum, no greater than 1 weight % of ruthenium, no greater than 1 weight % of palladium, no greater than 0.1 weight % of lanthanum, no greater than. 0.1 weight % of cerium, and no greater than 0.1 weight % of yttrium; and balance nickel and unavoidable impurities.

With the above composition, the Ni-based alloy of the invention comes to have not only sufficient anti-corrosion properties but also excellent workability in the hot working. In particular, the Ni-based alloy of the invention is the most useful when used in an environment containing chlorine ions, and is also sufficiently resistant to acids such as hydrochloric acid, hydrofluoric acid, oxalic acid, phosphoric acid, or nitric acid; alkalis such as sodium hydroxide; and sea water which is neutral.

The Ni-based alloy of the invention may further be modified so as to include 17 to 22 weight % of chromium; 19 to 24 weight % of molybdenum; wherein the sum of chromium plus molybdenum is greater than 38 weight %; no greater than 3.5 weight % of tantalum; 0.01 to 4 weight % of iron; and optionally no greater than 0.01 weight % of zirconium, no greater than 0.01 weight % of boron, no greater than 0.5 weight % of niobium, no greater than 2 weight % of tungsten and no greater than 2 weight % of copper, wherein $[4\times\text{niobium}+\text{tungsten}+\text{copper}]\leqq 2$weight %.

With this modification, the resulting Ni-based alloy comes to have excellent resistance to a variety of sulfuric acidic corrosive environments.

DETAILED DESCRIPTION OF THE INVENTION

Figure 1:
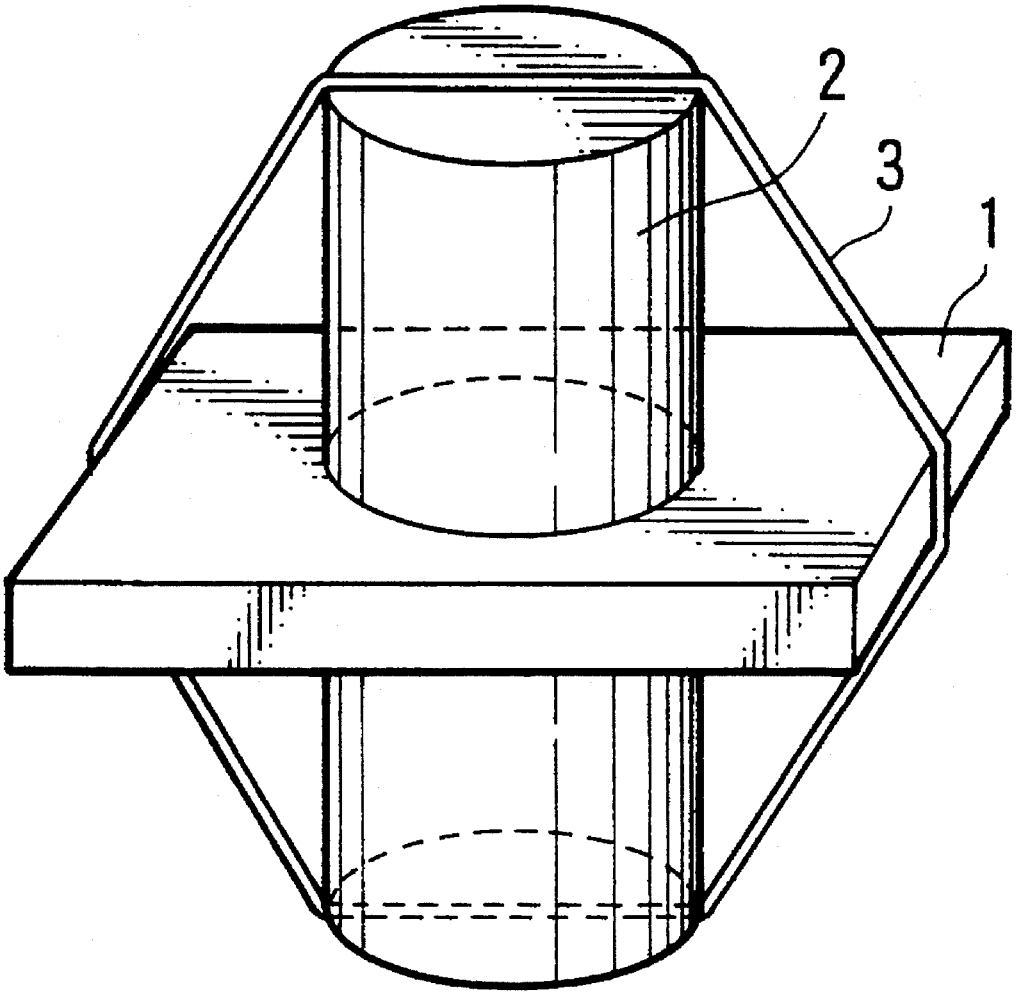
FIG. 1 is a perspective view showing a test piece used in a crevice corrosion test.

The inventors have made an extensive study to develop a novel Ni-based alloy which is excellent not only in anti-corrosion properties but also in workability, and as a result, they have found that the addition of Ta (tantalum) is essential to obtain the desired properties.

Thus, the Ni-based alloy in accordance with the present invention is characterized in that it contains 15 to 35 weight % of Cr (chromium); 6 to 24 weight % of Mo (molybdenum), wherein the sum of Cr plus Mo is no greater than 43 weight %; 1.1 to 8 weight % of Ta (tantalum); balance Ni (nickel) and unavoidable impurities.

Optionally, the Ni-based alloy may further include one or more of 0.0001 to 0.1 weight % of N (nitrogen), 0.0001 to 3 weight % of Mn (manganese), 0.0001 to 0.3 weight % of Si (silicon), 0.001 to 0.1 weight % of C (carbon), 0.01 to 6 weight % of Fe (iron), 0.001 to 0.1 weight % of B (boron), 0.001 to 0.1 weight % of Zr (zirconium), 0.001 to 0.01 weight % of Ca (calcium), 0.1 to 1 weight % of Nb (niobium), 0.1 to 4 weight % of W (tungsten), 0.1 to 4 weight % of Cu (copper), 0.05 to 0.8 weight % of Ti (titanium), 0.01 to 0.8 weight % of Al (aluminum), 0.1 to 5 weight % of Co (cobalt), 0.1 to 0.5 weight % of V (vanadium), 0.1 to 2 weight % of Hf (hafnium), 0.01 to 3 weight % of Re (rhenium), 0.01 to 1 weight % of Os (osmium), 0.01 to 1 weight % of Pt (platinum), 0.01 to 1 weight % of Ru (ruthenium), 0.01 to 1 weight % of Pd (palladium), 0.01 to 0.1 weight % of La (lanthanum), 0.01 to 0.1 weight % of Ce (cerium), and 0.01 to 0.1 weight % of Y (yttrium).

The reasons for the restrictions on the numerical ranges for respective essential or optional ingredients in the above Ni-based alloy will be now explained in detail.

Chromium

The Cr component is dissolved in the matrix to form a solid solution therewith, and improves anti-corrosion properties such as anti-pitting corrosion property and anti-crevice corrosion property in the environment containing chlorine ions. However, if the Cr content is less than 15 weight %, such advantages cannot be expected. On the other hand, if the Cr content exceeds 35 weight %, the other useful ingredients such as Mo and Ta are prevented from dissolving into the matrix, and the aforesaid corrosion properties are deteriorated due to less presence of such effective ingredients. Therefore, the Cr content is determined so as to range between 15 to 35 weight %. The most preferable range of the Cr content is from 17 to 22 weight % for the same reasons.

Molybdenum

The Mo component is also dissolved in the matrix to form a solid solution therewith, and improves anti-corrosion properties such as anti-pitting corrosion property and anti-crevice corrosion property in the environment containing chlorine ions. However, if the Mo content is less than 6 weight %, such advantages cannot be expected. On the other hand, if the Mo content exceeds 24 weight %, the workability in hot working is extremely deteriorated. Therefore, the Mo content is determined so as to range between 6 to 24 weight % The most preferable range of the Mo content is from 17 to 23 weight % due to the same reasons. Furthermore, if Mo and Cr are added in such an amount that their total amount exceeds 43 weight %, the hot-working workability is drastically deteriorated. Therefore, the sum of Mo plus Cr is determined so as to be no greater than 43 weight %.

Tantalum

The Ta component is dissolved in the matrix to form a solid solution therewith, and stabilizes and facilitates passivation film. Specifically, it is known that the passivation film which Ni—Cr—Mo alloy forms includes $NiOCr_2O_3$, and that minute $Cr_2O_3$ dominantly contributes as a protective film. When Ta is added, $Ta_2O_5$ which is stronger than $Cr_2O_3$ is formed in the passivation film to further stabilize the film, so that the anti-corrosion properties, such as anti-pitting corrosion property or anti-crevice corrosion property in an environment containing chlorine ions, can be further enhanced. However, if the Ta content is less than 1.1 weight %, such advantages cannot be obtained. On the other hand, if the Ta content exceeds 8 weight %, TCP phases, which are deleterious intermetallic compounds such as σ phase, P phase, Lavas phase, or μ phase, are formed in unacceptable amounts to deteriorate the workability in hot working. Therefore, the Ta content is determined so as to range between 1.1 to 8 weight %. The most preferable range of the Ta content is from 1.3 to 3.4 weight % for the same reasons. Furthermore, if Ta and Mo are added in such an amount that their total amount ranges from 13 to 26 weight %, the anti-corrosion properties can be further enhanced.

Nitrogen

The N component is dissolved in the matrix to form a solid solution therewith, and stabilizes the FCC phase and prevents the formation of deleterious TCP phases, so that the hot working workability is improved. Specifically, when Cr, Mo and Ta, which are added to improve the anti-corrosion properties, exceed certain amounts, TCP phases are unduly formed to lower the hot working workability. However, with the addition of N, the latent period for the formation of the TCP phases is prolonged to maintain the formed amount of the TCP phases in a permissible amount, and contributes to the stabilization of the FCC phases, so that the hot working workability is prevented from deteriorating. In the foregoing, if the N content is less than 0.0001 weight %, such advantages cannot be obtained. On the other hand, if the N content exceeds 0.1 weight %, nitrides such as $Cr_2N$ phase are separated in the matrix to deteriorate the hot working workability. Therefore, the N content is determined so as to range between 0.0001 to 0.1 weight %. The most preferable range of the N content is from 0.001 to 0.05 weight % for the same reasons.

Silicon

The Si, added as a deoxidizer, reduces oxides and prevents intercrystalline cracking. Therefore, Si reduces the intercrystalline cracking during the hot working operation to improve the hot working workability. However, if the Si content is less than 0.0001 weight %, such advantages cannot be obtained. On the other hand, if the Si content exceeds 0.3 weight %, TCP phases are formed in an undue amount to deteriorate the hot working workability. Therefore, the Si content is determined so as to range between 0.0001 to 0.3 weight %. The most preferable range of the Si content is from 0.0001 to 0.1 weight % for the same reasons.

Manganese

Although not as effective as N, the Mn component stabilizes FCC phase in the matrix to improve the anti-corrosion properties. However, if the Mn content is less than 0.0001 weight %, such advantages cannot be obtained. On the other hand, if the Mn content exceeds 3 weight %, TCP phases are unduly formed to lower the hot working workability. Therefore, the Mn content is determined so as to range between 0.0001 to 3 weight %. The most preferable range of the Mn content is from 0.0001 to 1 weight % for the same reasons.

Carbon

The C component is dissolved into the matrix to form a solid solution therewith, and stabilizes the FCC phase therein and improves the formation of deleterious TCP phases to improve the hot working workability. However, if the C content is less than 0.001 weight %, such advantages cannot be obtained. On the other hand, if the C content exceeds 0.1 weight %, the formation of carbides is unduly increased to lower the hot working workability. Therefore, the C content is determined so as to range between 0.001 to 0.1 weight %. The most preferable range of the C content is from 0.001 to 0.05 weight % for the same reasons.

Iron

As is the case with N, the Fe component is dissolved into the FCC phase in the matrix to form a substitution solid solution therewith, and stabilizes the FCC phase. Therefore, it improves the hot working workability. However, if the Fe content is less than 0.01 weight %, such advantages cannot be obtained. On the other hand, if the Fe content exceeds 6 weight %, it reduces the anti-corrosion properties in an environment containing chlorine ions, in particular anti-pitting corrosion property and anti-crevice corrosion property. Therefore, the Fe content is determined so as to range between 0.01 to 6 weight %. The most preferable range of the Fe content is from 0.05 to 4 weight for the same reasons.

Boron, Zirconium, Calcium

These ingredients enhance the hot working workability. However, if each of B, Zr and Ca is added in a respective amount of less than 0.001 weight %, such advantages cannot be obtained. On the other hand, if the amounts of B, Zr and Ca exceed 0.1 weight %, 0.1 weight % and 0.01 weight %, respectively, the hot working workability is then deteriorated. Therefore, the B, Zr and Ca contents are determined so as to range from 0.001 to 0.1 weight %, 0.001 to 0.1 weight % and 0.001 to 0.01 weight %, respectively. For the same reasons, the most preferable range is 0.002 to 0.01 weight % for B; 0.002 to 0.01 weight % for Zr; and 0.002 to 0.009 weight % for Ca.

Niobium, Tungsten, Copper

These ingredients enhance the anti-corrosion properties in an environment containing chlorine ions. However, if each amount of Nb, W and Cu is less than 0.1 weight %, such advantages cannot be obtained. On the other hand, if the amounts of Nb, W and Cu exceed 1 weight %, 4 weight % and 4 weight %, respectively, the formation of the TCP phases is unduly increased so that the hot working workability is deteriorated. Therefore, the Nb, W and Cu contents are determined so as to range from 0.1 to 1 weight %, 0.1 to 4 weight %, and 0.1 to 4 weight %, respectively. For the same reasons, the most preferable range is 0.15 to 0.5 weight % for Nb; 0.2 to 2 weight % for W; and 0.2 to 2 weight % for Cu.

Titanium, Aluminum, Cobalt, Vanadium

These ingredients enhance the hot working workability, in particular ductility and strength. However, if the Ti, Al, Co and V ingredients are less than 0.05 weight %, 0.01 weight %, 0.1 weight % and 0.1 weight %, respectively, such advantages cannot be obtained. On the other hand, if the Ti, Al, Co and V ingredients exceed 0.8 weight %, 0.8 weight 0.5 weight %, and 0.5 weight %, respectively, ductility is lowered. Therefore, the Ti, Al, Co and V contents are determined so as to range from 0.05 to 0.8 weight %, 0.01 to 0.8 weight %, 0.1 to 5 weight %, and 0.1 to 0.5 weight %, respectively. For the same reasons, the most preferable range is 0.08 to 0.4 weight % for Ti; 0.05 to 0.4 weight % for Al; 0.2 to 2 weight % for Co; and 0.2 to 0.4 weight % for V.

Hafnium, Rhenium

These ingredients enhance the anti-corrosion properties in an environment containing chlorine ions, such as anti-pitting corrosion property and anti-crevice corrosion property, and improves hot working workability. These ingredients are added especially when required to enhance these properties. However, if the Hf and Re ingredients are less than 0.1 weight % and 0.01 weight %, respectively, such advantages cannot be obtained. On the other hand, if the Hf and Re ingredients exceed 2 weight % and 3 weight %, respectively, the deleterious TCP phases are formed unduly so that the anti-corrosion properties and the hot working workability are extremely lowered. Therefore, the Hf and Re contents are determined so as to range from 0.1 to 2 weight % and 0.01 to 3 weight %, respectively. Due to the same reasons, the most preferable range is 0.2 to 1 weight % for Hf and 0.02 to 1 weight % for Re.

Osmium, Platinum, Ruthenium, Palladium

These ingredients are optionally added, and when at least one from these components is added, the hot working workability of the alloy is improved. However, if each of the Os, Pt, Ru and Pd ingredients is added in a respective amount of less than 0.01 weight %, such advantages cannot be obtained. On the other hand, if each of these ingredients is added in an amount exceeding 1 weight %, the deleterious TCP phases are formed unduly so that the hot working workability is extremely lowered. Therefore, these ingredients are determined so as to range from 0.01 to 1 weight %. For the same reasons, the most preferable range is 0.02 to 0.5 weight % for each of these ingredients.

Lanthanum, Cerium, Yttrium

These ingredients are optionally added, and improve anti-corrosion properties in the environment containing chlorine ions. However, if each of the La, Ce and Y ingredients is added only in an amount of less than 0.01 weight %, such advantages cannot be obtained. On the other hand, if each of these ingredients is added in an amount exceeding 0.1 weight %, the deleterious TCP phases are formed unduly so that the hot working workability is extremely lowered. Therefore, each of these ingredients is determined so as to range from 0.01 to 0.1 weight %. For the same reasons, the most preferable range is 0.02 to 0.08 weight % for La, 0.01 to 0.08 weight % for Ce and Y.

Impurities

It is inevitable that S (sulfur), Sn (tin), Zn (zinc) and Pb (lead) are included as impurities in the material to be melt. However, if the amounts of these impurities are no greater than 0.01 weight %, respectively, the alloy characteristics are not deteriorated at all.

In the aforesaid Ni-based alloy, Mg (magnesium) may be further included in an amount of 0.0001 to 0.3 weight % since Mg reduces intercrystalline cracking during hot working to improve the hot working workability. However, if the Mg content is less than 0.0001 weight %, such advantages cannot be obtained. On the other hand, if the Mg content exceeds 0.3 weight %, segregation occurs at grain boundaries, so that the hot working workability is lowered. Therefore, the Mg content is determined so as to range from 0.0001 to 0.3 weight %. The more preferable range for the Mg content is from 0.001 to 0.1 weight %.

The Ni-based alloys in accordance with the present invention are excellent in both hot working workability and anti-corrosion properties. Accordingly, they can be used to manufacture devices of complicated shapes used in severe environments containing chlorine ions, such as bleaching devices in the paper and pulp industry, pipings for hydrogen gas for halogenation, or HCl recovery columns.

As described above, the Ni-based alloys of the invention are the most useful when used in an environment containing chlorine ions. However, the application is not limited to such use, and they may be used in environments which contain acids such as hydrochloric acid, hydrofluoric acid, oxalic acid, phosphoric acid, or nitric acid; alkalis such as sodium hydroxide; and sea water which is neutral.

Furthermore, the inventors have found that among the Ni-based alloys of the invention, some specific alloys are very resistant to a variety of sulfuric acid corrosion. More specifically, the inventors have classified the sulfuric acid environment into the following three categories:

(a) a sulfuric acid environment of 60% and 80% sulfuric acid at 120° C.;

(b) a sulfuric acid environment containing chlorine ions which has reducing acidic characteristic;

(c) a sulfuric acid environment containing active carbon (i.e., unburned carbon), $Fe^{3+}$ or $HNO_3$ which is more corrosive with respect to oxidizing acidic characteristics.

The inventors have made extensive study to develop Ni-based alloys which have excellent anti-corrosion properties in the aforesaid sulfuric acid environments. As a result, they have found that a Ni-based alloy containing 17 to 22 weight % of Cr; 19 to 24 weight % of Mo, wherein the sum of Cr plus Mo is greater than 38 weight %; 0.01 to 4.0 weight % of Fe; no greater than 3.5 weight % of Ta. Optionally, at least one selected from the group consisting of 0.001 to 0.01 weight % of Zr and 0.001 to 0.01 weight % of B may be included. Furthermore, at least one of 0.1 to 0.5 weight % of Nb, 0.1 to 2.0 weight % of W, and 0.1 to 2.0 weight % of Cu may be added so as to satisfy that the total of 4Nb+W+Cu is no greater than 2.0 weight %.

In the foregoing, the numerical ranges for respective ingredients have been determined due to the following reasons.

Chromium, Molybdenum

As described before, the Cr and Mo components improve anti-corrosion properties, but the Cr component in particular improves the anti-corrosion property against oxidizing acids, whereas Mo enhances such properties against the non-oxidizing acids. Therefore, it is appreciated that the simultaneous addition of Cr and Mo with Ta makes the alloy to be substantially resistant in various sulfuric acidic environments. However, if the Cr content is less than 17 weight %, it is difficult to form a passivation film on the alloy surface minute enough to impart sufficient resistance to sulfuric acid. The upper limit of 22 weight % is set simply because sufficient workability is expected within this range.

Furthermore, if the Mo content is less than 19 weight %, sufficient anti-corrosive property against sulfuric acid cannot be obtained. On the other hand, if the Mo content exceeds 24 weight %, the resistance to the sulfuric acid including oxidizing acid is reduced. Therefore, the Mo content is determined so as to range from 19 to 24 weight %.

In the foregoing, Cr and Mo have properties opposite to each other. Therefore, it is important to balance the Cr and Mo contents with each other, and to determine the amount of Cr plus Mo so as to range from 38 to 43 weight %. Otherwise, the anti-corrosion property with respect to sulfuric acid is deteriorated. Accordingly, the sum of Cr plus Mo is determined so as to be greater than 38 weight % and be no greater than 43 weight %.

Tantalum

In order to ensure the well-balanced resistance to a variety of the sulfuric acidic environments, the Ta content should be from 1.1 to 3.5 weight %. For the same reasons, the most preferable range is from 1.5 to 2.5 weight %.

Iron

In order to improve the workability of plastic working, it is preferable that Fe be added in an amount of no less than 0.01 weight %. However, if the Fe content exceeds 4.0 weight %, the anti-corrosion property with respect to the sulfuric acid is deteriorated. Therefore, the Fe content has been set from 0.01 to 4.0 weight %.

Boron, Zirconium

The B and Zr contents are determined so as to preferably range from 0.001 to 0.01 weight % due to the same reasons as mentioned above.

Niobium, Tungsten, Copper

In order to ensure sufficient anti-corrosion properties with respect to the sulfuric acids as well as excellent workability, the Nb, W and Cu contents are determined so as to range from 0.1 to 0.5 weight %, 0.1 to 2.0 weight %, and 0.1 to 2.0 weight %, respectively. In addition, the sum of 4Nb+W+Cu should be no greater than 2 weight % in order to ensure superior workability.

The invention will be more detailedly explained by way of the following examples.

EXAMPLE 1

The raw materials were melted in a high-frequency melting furnace in an atmosphere which was set to that of a mixture of argon and nitrogen gases and the mixing ratio of $N_2$ as well as the pressure of the mixture were varied. The melt was cast into molds to provide ingots having a diameter of 60 mm and a length of 200 mm. The ingots thus obtained were melt again in an electroslag melting furnace to provide ingots having a diameter of 100 mm and compositions shown in Tables 1 to 15. The ingots were then subjected to homogenization treatment while keeping them at a prescribed temperature between 1150° to 1250° C. for 10 hours, and parts of the ingots were cut as test pieces for high-temperature compression tests, while the remainder was subjected to hot forging and hot rolling at prescribed temperatures between 1000° to 1250° C. to produce hot-rolled plates 5 mm thick.

The rolled plates thus obtained were subjected to solution heat treatment by keeping them at a prescribed temperature ranging from 1150° to 1250° C. for 30 minutes, and were further subjected to cold rolling to provide cold-rolled plates 3 mm thick. Subsequently, the cold-rolled plates were further subjected to solution heat treatment by keeping them at a prescribed temperature ranging from 1150° to 1250° C. for 30 minutes to provide Ni-based alloy plates 1 to 72 of the invention and comparative Ni-based alloy plates 1 to 14.

Furthermore, conventional Ni-based alloy plates 1 to 4 were produced by "alloy 55C", "alloy 625", "alloy C-276" and "alloy C-22", respectively.

With respect to the Ni-based alloy plates 1 to 72 of the invention, the comparative Ni-based alloy plates 1 to 14, and the conventional Ni-based alloy plates 1 to 4, the high-temperature compression test, the high-temperature tension test, and anti-pitting corrosion and anti-crevice corrosion tests in the environment containing chlorine ions were carried out.

High-Temperature Compression Test

Cylindrical test pieces of 8 mm in diameter and 12 mm long were cut from the ingots by means of electrical discharging, and held at 1,100° C. for 15 minutes. Then, the test pieces were compressed at a rate of strain of 1.0 mm/sec to a target distortion of 50%, and the stresses when compressed at 10% distortion were measured to evaluate the hot working workability. The results are set forth in Tables 16 to 21.

High-Temperature Tension Test

Test pieces for high-temperature tension test were obtained from the cold-rolled plates 3 mm thick, and after having been held at a high temperature of 800° C. for 15 minutes, the test pieces were tensioned at 0.15 mm/min up to 0.2% proof stress and at 1.50 mm/min after 0.2% proof stress. Then, the elongation until breakage was performed to evaluate the workability in hot working. The results are shown in Tables 16 to 21.

Anti-Pitting Corrosion Test in Environment Containing Chlorine Ions

Test pieces of 35 mm in both length and width were prepared from the cold-rolled plates 3 mm thick, and were subjected to wet grinding to smooth the surface up to #2400. Then, the test pieces were immersed in an aqueous solution of 150° C. and pH of 2 and containing 4% of NaCl, 0.1% of $Fe_2(SO_4)_3$, 0.01 Mol of HCl, and 24300 ppm of Cl— for 24 hours, and then the presence of the pitting corrosion was examined microscopically at a magnification of 40. The results of the measurements are shown in Tables 16 to 21.

Anti-Crevice Corrosion Test in Environment Containing Chlorine Ions

Test pieces of 35 mm in both length and width were prepared from the cold-rolled plates 3 mm thick, and were subjected to wet grinding to smooth the surface up to #2400. Then, in accordance with ASTM Practice G46-76B, test pieces each as shown in FIG. 1 were prepared by securing a respective plate-like test piece 1 and a respective Teflon round rod 2 by a rubber cord 3 or the like, to provide test pieces for pitting corrosion. The test pieces were then immersed in a boiling aqueous solution containing 11.5% of $H_2SO_4$, 1.2% of HCl, 1% of $FeCl_3$, 1% of $CuCl_2$ for 24 hours, and then the depth of corrosion was measured. The results of the measurements are also shown in Tables 16 to 21.

As will be seen from the results shown in Tables 1 to 21, the Ni-based alloy plates 1–72 of the invention are superior in workability in hot working to the conventional Ni-based alloy plate 1, and superior in the anti-corrosion properties in an environment containing chlorine ions over the conventional Ni-based alloy plates 2, 3 and 4. Therefore, the Ni-based alloy plates 1 to 72 of the invention are superior in both the hot working workability and anti-corrosion properties when compared with the conventional Ni-based alloy plates. Furthermore, as seen with the comparative Ni-based alloy plates 1 to 14, if the composition falls outside the claimed ranges, at least one of the hot working workability and the anti-corrosion properties is inferior.

EXAMPLE 2

The same procedures as in Example 1 were repeated to produce ingots of 100 mm in diameter having compositions as shown in Tables 22 to 36, and to prepare Ni-based alloy plates 73 to 144 of the invention and comparative Ni-based alloy plates 15 to 27. Furthermore, the conventional Ni-based alloy plates 1 to 4 were again used and shown in Table 36.

With respect to the Ni-based alloy plates 73 to 144 of the invention and the comparative Ni-based alloy plates 15 to 26, the high-temperature compression test, the high-temperature tension test, and anti-pitting corrosion and anti-crevice corrosion tests in the environment containing chlorine ions were carried out. The results are shown in Tables 37 to 42.

As will be seen from Tables 37 to 42, the Ni-based alloy plates 73 to 144 of the invention are superior in workability in hot working to the conventional Ni-based alloy plate 1, and superior in the anti-corrosion properties in an environment containing chlorine ions over the conventional Ni-based alloy plates 2 to 4. Therefore, the Ni-based alloy plates 73 to 144 of the invention are superior in both the hot working workability and anti-corrosion properties when compared with the conventional Ni-based alloy plates. Furthermore, as seen with the comparative Ni-based alloy plates 15 to 27, if the composition falls outside the claimed ranges, at least one of the hot working workability and the anti-corrosion properties is inferior.

EXAMPLE 3

The raw materials were melted in a high-frequency melting furnace, and the melt was cast into ingots of 8.5 mm thick having compositions shown in Tables 43 to 46. The ingots thus obtained were heated to a temperature ranging from 1,000° to 1,230° C., and while maintaining them at this temperature, hot rolling operation was once carried out to reduce the thickness to 8 mm. Subsequently, by carrying out the hot rolling operation several times and reducing the thickness 1 mm for each operation, the thickness was reduced to 3 mm. Thus, Ni-based alloy plates 145 to 168 of the invention, comparative Ni-based alloy plates 28 to 43 and conventional Ni-based alloys 5 to 9, each of which has a thickness of 3 mm, were prepared. These Ni-based alloy plates were all examined as to the presence of cracks during the rolling operation, and the results of the examination are set forth in Tables 43 to 46. Furthermore, the aforesaid Ni-based alloys were cut into test pieces of 25 mm in length and 50 mm in breadth. Furthermore, 60% of $H_2SO_4$, 80% of $H_2SO_4$, a solution in which 1 g of active carbon was suspended in 3 cc of 60% of $H_2SO_4$ (hereinafter referred to as "60% $H_2SO_4$ with active carbon"), a solution in which 1 g of active carbon was suspended in 3 cc of 80% of $H_2SO_4$ (hereinafter referred to as "80% $H_2SO_4$ with active carbon"), a solution in which 100 ppm of HCl was added to 60% of $H_2SO_4$ (hereinafter referred to as "60% $H_2SO_4$+100 ppm HCl"), a solution in which 10 ppm of $HNO_3$ was added to 60% of $H_2SO_4$ (hereinafter referred to as "60% $H_2SO_4$+10 ppm $HNO_3$"), and a solution in which 400 ppm of $Fe^{3+}$ was added as $Fe_2(SO_4)_3$ to 60% of $H_2SO_4$ (hereinafter referred to as "60% $H_2SO_4$+400 ppm $Fe^{3+}$") were prepared. These sulfuric acid solutions were heated to 120° C., and the Ni-based alloys of the invention, the comparative Ni-based alloys and the prior art Ni-based alloys were immersed in these sulfuric acid solutions for 24 hours. Then, taking the alloys out, their weights were measured, and by dividing the reduced weight by the surface area, the rate of corrosion for one year was calculated. The results are set forth in Tables 47 to 50.

As will be seen from Tables 43 to 50, the Ni-based alloy plates 145 to 168 of the invention are excellent in hot working workability because no cracks ocurred during the hot rolling operations. In addition, the rates of corrosion against 60% of $H_2SO_4$, 80% of $H_2SO_4$, 60% $H_2SO_4$ with active carbon, 80% $H_2SO_4$ with active carbon, 60% $H_2SO_4$+100 ppm HCl, 60% $H_2SO_4$+10 ppm $HNO_3$, and 60% $H_2SO_4$+400 ppm $Fe^{3+}$, were all less than 1 mm/year. Thus, the Ni-based alloy plates 145 to 168 of the invention are excellent in resistance to various sulfuric acidic environments.

In contrast, some of the comparative Ni-based alloy plates and the prior art Ni-based alloy plates exhibited rates of corrosion exceeding 1 mm/year, while others exhibited rates of corrosion of less than 1 mm/year, but cracked during hot rolling operation and were inferior in workability.

Finally, the present application claims the priorities of Japanese Patent Application No. 5-256360 filed Sep. 20, 1993, Japanese Patent Application No. 6-135079 filed on May 25, 1994, and Japanese Patent Application No. 6-15097 filed on Jun. 17, 1994, which are all incorporated herein by reference.

TABLE 1

| | Ni-based alloy plate of the present invention (unit: weight %) | | | | | |
|---|---|---|---|---|---|---|
| element | 1 | 2 | 3 | 4 | 5 | 6 |
| Cr | 20.1 | 21.2 | 19.9 | 21.0 | 18.8 | 19.2 |
| Mo | 19.7 | 20.8 | 21.9 | 18.2 | 17.4 | 20.9 |
| Ta | 1.72 | 1.53 | 1.23 | 3.34 | 3.01 | 1.75 |
| N | 0.0006 | 0.0284 | 0.0342 | 0.0481 | 0.0083 | 0.0445 |
| Si | 0.0214 | 0.0325 | 0.0224 | 0.0432 | 0.0342 | 0.0016 |
| Mn | 0.0729 | 0.0816 | 0.4253 | 0.8425 | 0.1926 | 0.2856 |
| C | 0.0058 | 0.0088 | 0.0120 | 0.0109 | 0.0083 | 0.0125 |
| Fe | 0.05 | 1.01 | 3.84 | 0.11 | 0.51 | 0.88 |
| B | 0.003 | — | — | 0.009 | 0.005 | — |
| Zr | — | 0.004 | — | 0.002 | 0.007 | 0.003 |
| Ca | — | — | 0.002 | — | 0.001 | 0.008 |
| Nb | — | — | — | — | — | — |
| W | — | — | — | — | — | — |
| Cu | — | — | — | — | — | — |
| Ti | — | — | — | — | — | — |
| Al | — | — | — | — | — | — |
| Co | — | — | — | — | — | — |
| V | — | — | — | — | — | — |
| Hf | — | — | — | — | — | — |
| Re | — | — | — | — | — | — |
| Os, Pt | — | — | — | — | — | — |
| Pd, Ru | — | — | — | — | — | — |
| La, Ce, Y | — | — | — | — | — | — |
| Ni + imp | bal. | bal. | bal. | bal. | bal. | bal. |

(Note: "imp" represents unavoidable impurities.)

TABLE 2

| | Ni-based alloy plate of the present invention (unit: weight %) | | | | | |
|---|---|---|---|---|---|---|
| element | 7 | 8 | 9 | 10 | 11 | 12 |
| Cr | 17.9 | 18.0 | 20.5 | 21.2 | 19.8 | 19.2 |
| Mo | 20.1 | 22.3 | 20.6 | 21.0 | 20.7 | 21.5 |
| Ta | 1.55 | 2.51 | 1.88 | 1.65 | 1.38 | 1.92 |
| N | 0.0342 | 0.0253 | 0.0009 | 0.0083 | 0.0127 | 0.0210 |
| Si | 0.0026 | 0.0098 | 0.0002 | 0.0981 | 0.0218 | 0.0113 |
| Mn | 0.0172 | 0.0036 | 0.0018 | 0.0173 | 0.0003 | 0.9856 |
| C | 0.0141 | 0.0075 | 0.0098 | 0.0105 | 0.0121 | 0.0029 |
| Fe | 0.01 | 1.24 | 1.05 | 2.13 | 1.18 | 1.79 |

TABLE 2-continued

| | Ni-based alloy plate of the present invention (unit: weight %) | | | | | |
|---|---|---|---|---|---|---|
| element | 7 | 8 | 9 | 10 | 11 | 12 |
| B | 0.002 | — | — | 0.003 | — | — |
| Zr | — | 0.003 | — | — | 0.007 | — |
| Ca | — | — | 0.007 | 0.002 | — | 0.06 |
| Nb | — | — | — | — | — | — |
| W | — | — | — | — | — | — |
| Cu | — | — | — | — | — | — |
| Ti | — | — | — | — | — | — |
| Al | — | — | — | — | — | — |
| Co | — | — | — | — | — | — |
| V | — | — | — | — | — | — |
| Hf | — | — | — | — | — | — |
| Re | — | — | — | — | — | — |
| Os, Pt | — | — | — | — | — | — |
| Pd, Ru | — | — | — | — | — | — |
| La, Ce, Y | — | — | — | — | — | — |
| Ni + imp | bal. | bal. | bal. | bal. | bal. | bal. |

(Note: "imp" represents unavoidable impurities.)

TABLE 3

| | Ni-based alloy plate of the present invention (unit: weight %) | | | | | |
|---|---|---|---|---|---|---|
| element | 13 | 14 | 15 | 16 | 17 | 18 |
| Cr | 20.6 | 21.0 | 20.0 | 18.7 | 15.2 | 24.8 |
| Mo | 22.1 | 21.3 | 19.7 | 23.8 | 23.6 | 17.9 |
| Ta | 2.08 | 2.21 | 2.03 | 1.15 | 1.88 | 2.05 |
| N | 0.0382 | 0.0415 | 0.0002 | 0.0243 | 0.0305 | 0.0412 |
| Si | 0.0714 | 0.0514 | 0.0873 | 0.2982 | 0.0832 | 0.0726 |
| Mn | 0.5216 | 0.4266 | 0.0025 | 0.0139 | 0.0281 | 2.9526 |
| C | 0.0014 | 0.0148 | 0.0083 | 0.0027 | 0.0191 | 0.0153 |
| Fe | — | — | — | — | — | — |
| B | — | 0.004 | 0.002 | — | — | — |
| Zr | — | — | — | — | — | 0.011 |
| Ca | — | — | — | — | — | — |
| Nb | — | — | — | — | — | — |
| W | — | — | — | — | — | — |
| Cu | — | — | — | — | — | — |
| Ti | — | — | — | — | — | — |
| Al | — | — | — | — | — | — |
| Co | — | — | — | — | — | — |
| V | — | — | — | — | — | — |
| Hf | — | — | — | — | — | — |
| Re | — | — | — | — | — | — |
| Os, Pt | — | — | — | — | — | — |
| Pd, Ru | — | — | — | — | — | — |
| La, Ce, Y | — | — | — | — | — | — |
| Ni + imp | bal. | bal. | bal. | bal. | bal. | bal. |

(Note: "imp" represents unavoidable impurities.)

TABLE 4

| | Ni-based alloy plate of the present invention (unit: weight %) | | | | | |
|---|---|---|---|---|---|---|
| element | 19 | 20 | 21 | 22 | 23 | 24 |
| Cr | 28.8 | 25.6 | 20.4 | 15.6 | 32.8 | 27.8 |
| Mo | 14.1 | 14.3 | 14.2 | 14.6 | 10.1 | 10.0 |
| Ta | 4.12 | 4.23 | 4.52 | 4.78 | 6.03 | 6.22 |
| N | 0.0008 | 0.0551 | 0.0953 | 0.0355 | 0.0521 | 0.0148 |
| Si | 0.0528 | 0.0533 | 0.0216 | 0.0038 | 0.1273 | 0.0786 |
| Mn | 0.1726 | 0.8362 | 0.7261 | 0.6836 | 0.5106 | 0.2128 |
| C | 0.0091 | 0.2918 | 0.0732 | 0.0150 | 0.0138 | 0.0129 |
| Fe | — | — | — | — | — | — |
| B | — | — | — | — | — | — |
| Zr | 0.007 | — | — | — | — | — |
| Ca | — | 0.003 | 0.006 | — | — | — |
| Nb | — | — | — | — | — | — |
| W | — | — | — | 0.14 | 0.22 | — |

TABLE 4-continued

| element | Ni-based alloy plate of the present invention (unit: weight %) 19 | 20 | 21 | 22 | 23 | 24 |
|---|---|---|---|---|---|---|
| Cu | — | — | — | — | — | — |
| Ti | — | — | — | — | — | — |
| Al | — | — | — | — | — | — |
| Co | — | — | — | — | — | — |
| V | — | — | — | — | — | — |
| Hf | — | — | — | — | — | — |
| Re | — | — | — | — | — | — |
| Os, Pt | — | — | — | — | — | — |
| Pd, Ru | — | — | — | — | — | — |
| La, Ce, Y | — | — | — | — | — | — |
| Ni + imp | bal. | bal. | bal. | bal. | bal. | bal. |

(Note: "imp" represents unavoidable impurities.)

TABLE 5

| element | Ni-based alloy plate of the present invention (unit: weight %) 25 | 26 | 27 | 28 | 29 | 30 |
|---|---|---|---|---|---|---|
| Cr | 20.6 | 15.8 | 34.4 | 30.0 | 25.3 | 19.9 |
| Mo | 10.1 | 10.4 | 6.3 | 6.2 | 6.4 | 6.1 |
| Ta | 6.23 | 6.88 | 7.52 | 7.66 | 7.82 | 7.93 |
| N | 0.0342 | 0.0368 | 0.0485 | 0.0298 | 0.0412 | 0.0511 |
| Si | 0.0732 | 0.0801 | 0.0656 | 0.0521 | 0.0853 | 0.0729 |
| Mn | 0.1126 | 0.0833 | 0.1928 | 2.0215 | 0.3956 | 0.3882 |
| C | 0.0138 | 0.0162 | 0.0231 | 0.0339 | 0.0056 | 0.0138 |
| Fe | — | — | — | — | — | — |
| B | — | — | — | — | — | — |
| Zr | — | — | — | — | — | — |
| Ca | — | — | — | — | — | — |
| Nb | — | — | — | — | — | — |
| W | — | — | — | — | — | — |
| Cu | — | — | — | — | — | — |
| Ti | — | — | — | — | — | — |
| Al | — | — | — | — | — | — |
| Co | — | — | — | — | — | — |
| V | — | — | — | — | — | — |
| Hf | — | — | — | — | — | — |
| Re | — | — | — | — | — | — |
| Os, Pt | — | — | — | — | — | — |
| Pd, Ru | — | — | — | — | — | — |
| La, Ce, Y | — | — | — | — | — | — |
| Ni + imp | bal. | bal. | bal. | bal. | bal. | bal. |

(Note: "imp" represents unavoidable impurities.)

TABLE 6

| element | Ni-based alloy plate of the present invention (unit: weight %) 31 | 32 | 33 | 34 | 35 | 36 |
|---|---|---|---|---|---|---|
| Cr | 15.4 | 19.2 | 17.2 | 18.8 | 21.7 | 22.5 |
| Mo | 6.4 | 19.1 | 18.3 | 18.2 | 18.1 | 17.8 |
| Ta | 7.75 | 1.91 | 2.49 | 2.11 | 2.91 | 3.07 |
| N | 0.0315 | 0.0265 | 0.0422 | 0.0543 | 0.0186 | 0.0312 |
| Si | 0.0886 | 0.0387 | 0.0116 | 0.0083 | 0.0062 | 0.0787 |
| Mn | 0.2565 | 0.2283 | 0.0391 | 0.0598 | 0.7382 | 0.0084 |
| C | 0.0072 | 0.0081 | 0.0115 | 0.0101 | 0.0073 | 0.0114 |
| Fe | — | 0.02 | 5.82 | — | — | — |
| B | — | — | — | — | — | — |
| Zr | — | — | — | — | — | — |
| Ca | — | — | — | — | — | — |
| Nb | — | — | — | 0.14 | 0.92 | — |
| W | — | — | — | — | — | 0.17 |
| Cu | — | — | — | — | — | — |
| Ti | — | — | — | — | — | — |
| Al | — | — | — | — | — | — |
| Co | — | — | — | — | — | — |
| V | — | — | — | — | — | — |

TABLE 6-continued

| element | Ni-based alloy plate of the present invention (unit: weight %) 31 | 32 | 33 | 34 | 35 | 36 |
|---|---|---|---|---|---|---|
| Hf | — | — | — | — | — | — |
| Re | — | — | — | — | — | — |
| Os, Pt | — | — | — | — | — | — |
| Pd, Ru | — | — | — | — | — | — |
| La, Ce, Y | — | — | — | — | — | — |
| Ni + imp | bal. | bal. | bal. | bal. | bal. | bal. |

(Note: "imp" represents unavoidable impurities.)

TABLE 7

| element | Ni-based alloy plate of the present invention (unit: weight %) 37 | 38 | 39 | 40 | 41 | 42 |
|---|---|---|---|---|---|---|
| Cr | 34.7 | 21.6 | 17.3 | 22.6 | 20.6 | 16.5 |
| Mo | 8.2 | 18.1 | 20.8 | 16.9 | 18.3 | 9.7 |
| Ta | 4.97 | 1.52 | 2.63 | 1.55 | 1.69 | 4.52 |
| N | 0.0006 | 0.0008 | 0.0185 | 0.0215 | 0.0352 | 0.0495 |
| Si | 0.0891 | 0.0935 | 0.0658 | 0.0756 | 0.0328 | 0.0051 |
| Mn | 0.6921 | 0.5918 | 0.2913 | 0.1285 | 0.0562 | 0.0836 |
| C | 0.0131 | 0.0093 | 0.0085 | 0.0064 | 0.1183 | 0.0143 |
| Fe | — | 0.02 | 5.82 | — | 0.25 | — |
| B | — | — | — | 0.084 | — | — |
| Zr | — | — | — | — | 0.091 | — |
| Ca | — | — | — | — | — | 0.008 |
| Nb | — | — | — | 0.16 | 0.38 | 0.26 |
| W | 3.88 | — | — | — | 2.29 | 3.21 |
| Cu | — | 0.12 | 3.94 | 1.15 | — | 2.22 |
| Ti | — | — | — | — | — | — |
| Al | — | — | — | — | — | — |
| Co | — | — | — | — | — | — |
| V | — | — | — | — | — | — |
| Hf | — | — | — | — | — | — |
| Re | — | — | — | — | — | — |
| Os, Pt | — | — | — | — | — | — |
| Pd, Ru | — | — | — | — | — | — |
| La, Ce, Y | — | — | — | — | — | — |
| Ni + imp | bal. | bal. | bal. | bal. | bal. | bal. |

(Note: "imp" represents unavoidable impurities.)

TABLE 8

| element | Ni-based alloy plate of the present invention (unit: weight %) 43 | 44 | 45 | 46 | 47 | 48 |
|---|---|---|---|---|---|---|
| Cr | 20.3 | 19.6 | 18.2 | 21.1 | 20.5 | 21.5 |
| Mo | 20.6 | 19.7 | 21.8 | 19.2 | 18.3 | 19.7 |
| Ta | 1.71 | 1.33 | 1.99 | 2.25 | 2.00 | 2.09 |
| N | 0.0522 | 0.0362 | 0.0048 | 0.0162 | 0.0315 | 0.0223 |
| Si | 0.0933 | 0.0526 | 0.0625 | 0.0328 | 0.0362 | 0.0413 |
| Mn | 0.4381 | 0.2795 | 0.0595 | 0.0287 | 0.1316 | 0.1425 |
| C | 0.0124 | 0.0078 | 1.0056 | 0.0038 | 0.0127 | 0.0062 |
| Fe | — | — | — | — | 0.04 | — |
| B | — | — | — | — | — | — |
| Zr | — | — | — | — | 0.043 | — |
| Ca | — | — | — | — | — | — |
| Nb | — | — | — | — | — | — |
| W | — | — | — | — | — | — |
| Cu | — | — | — | — | 0.52 | — |
| Ti | 0.06 | 0.78 | — | — | 0.09 | — |
| Al | — | — | 0.02 | 0.77 | 0.24 | — |
| Co | — | — | — | — | — | 0.14 |
| V | — | — | — | — | — | — |
| Hf | — | — | — | — | — | — |
| Re | — | — | — | — | — | — |
| Os, Pt | — | — | — | — | — | — |
| Pd, Ru | — | — | — | — | — | — |
| La, Ce, Y | — | — | — | — | — | — |

TABLE 8-continued

| element | Ni-based alloy plate of the present invention (unit: weight %) 43 | 44 | 45 | 46 | 47 | 48 |
|---|---|---|---|---|---|---|
| Ni + imp | bal. | bal. | bal. | bal. | bal. | bal. |

(Note: "imp" represents unavoidable impurities.)

TABLE 9

| element | Ni-based alloy plate of the present invention (unit: weight %) 49 | 50 | 51 | 52 | 53 | 54 |
|---|---|---|---|---|---|---|
| Cr | 17.6 | 20.5 | 22.5 | 20.3 | 19.8 | 21.3 |
| Mo | 18.1 | 19.2 | 14.2 | 18.5 | 21.2 | 18.6 |
| Ta | 1.66 | 2.56 | 1.25 | 2.12 | 1.52 | 2.53 |
| N | 0.0245 | 0.0538 | 0.0342 | 0.0391 | 0.0272 | 0.0353 |
| Si | 0.0386 | 0.0278 | 0.0088 | 0.0096 | 0.0121 | 0.0235 |
| Mn | 0.8295 | 0.4365 | 0.0027 | 0.0039 | 0.0021 | 0.0285 |
| C | 0.0078 | 0.0114 | 0.0081 | 0.0125 | 0.0112 | 0.0087 |
| Fe | — | — | — | 1.25 | — | — |
| B | — | — | — | 0.009 | — | — |
| Zr | — | — | — | — | — | — |
| Ca | — | — | — | — | — | — |
| Nb | — | — | — | 0.14 | — | — |
| W | — | — | — | — | — | — |
| Cu | — | — | — | — | — | — |
| Ti | — | — | — | 0.34 | — | — |
| Al | — | — | — | — | — | — |
| Co | 4.83 | — | — | 2.03 | — | — |
| V | — | 0.12 | 0.47 | 0.13 | — | — |
| Hf | — | — | — | — | 0.15 | 1.93 |
| Re | — | — | — | — | — | — |
| Os, Pt | — | — | — | — | — | — |
| Pd, Ru | — | — | — | — | — | — |
| La, Ce, Y | — | — | — | — | — | — |
| Ni + imp | bal. | bal. | bal. | bal. | bal. | bal. |

(Note: "imp" represents unavoidable impurities.)

TABLE 10

| element | Ni-based alloy plate of the present invention (unit: weight %) 55 | 56 | 57 | 58 | 59 | 60 |
|---|---|---|---|---|---|---|
| Cr | 15.7 | 30.6 | 25.6 | 20.3 | 21.6 | 20.3 |
| Mo | 15.8 | 10.9 | 12.3 | 19.9 | 18.6 | 19.2 |
| Ta | 4.91 | 6.21 | 4.21 | 2.25 | 2.81 | 1.98 |
| N | 0.0432 | 0.0495 | 0.0814 | 0.0515 | 0.0622 | 0.0461 |
| Si | 0.0165 | 0.0238 | 0.0838 | 0.0959 | 0.0287 | 0.0742 |
| Mn | 0.1138 | 0.1925 | 0.8231 | 0.4956 | 0.3692 | 0.3815 |
| C | 0.0122 | 0.0145 | 0.0121 | 0.0138 | 0.0129 | 0.0081 |
| Fe | — | — | — | — | — | — |
| B | — | — | — | — | — | — |
| Zr | — | — | — | — | — | — |
| Ca | — | — | — | — | — | — |
| Nb | — | — | — | — | — | — |
| W | — | — | — | — | — | — |
| Cu | — | — | — | — | — | — |
| Ti | — | — | — | — | — | — |
| Al | — | — | — | — | — | — |
| Co | — | — | — | — | — | — |
| V | — | — | — | — | — | — |
| Hf | — | — | — | — | — | — |
| Re | 0.02 | 2.96 | — | — | — | — |
| Os, Pt | — | — | Os:0.02 | Os:1.93 | Pt:0.02 | Pt:0.88 |
| Pd, Ru | — | — | — | — | — | — |
| La, Ce, Y | — | — | — | — | — | — |
| Ni + imp | bal. | bal. | bal. | bal. | bal. | bal. |

(Note: "imp" represents unavoidable impurities.)

TABLE 11

| element | Ni-based alloy plate of the present invention (unit: weight %) 61 | 62 | 63 | 64 | 65 | 66 |
|---|---|---|---|---|---|---|
| Cr | 20.6 | 17.9 | 21.9 | 19.6 | 22.5 | 18.8 |
| Mo | 20.3 | 16.8 | 18.3 | 17.2 | 18.1 | 17.3 |
| Ta | 1.15 | 3.27 | 2.55 | 3.86 | 1.75 | 3.58 |
| N | 0.0372 | 0.0288 | 0.0344 | 0.0141 | 0.0292 | 0.0233 |
| Si | 0.0555 | 0.0568 | 0.0090 | 0.0832 | 0.0950 | 0.0822 |
| Mn | 0.4362 | 0.2855 | 0.0291 | 0.0036 | 0.0004 | 0.0028 |
| C | 0.0079 | 0.0111 | 0.0027 | 0.0104 | 0.0085 | 0.0073 |
| Fe | — | — | — | — | — | — |
| B | — | — | — | — | — | — |
| Zr | — | — | — | — | — | — |
| Ca | — | — | — | — | — | — |
| Nb | — | — | — | — | — | — |
| W | — | — | — | — | — | — |
| Cu | — | — | — | — | — | — |
| Ti | — | — | — | — | — | — |
| Al | — | — | — | — | — | — |
| Co | — | — | — | — | — | — |
| V | — | — | — | — | — | — |
| Hf | — | — | — | — | — | — |
| Re | — | — | — | — | — | — |
| Os, Pt | — | — | — | — | Os:0.57 | Pt:0.52 |
| Pd, Ru | Ru:0.01 | Ru:0.93 | Pd:0.02 | Pd:0.89 | Pd:0.21 | Ru:0.33 |
| La, Ce, Y | — | — | — | — | — | — |
| Ni + imp | bal. | bal. | bal. | bal. | bal. | bal. |

(Note: "imp" represents unavoidable impurities.)

TABLE 12

| element | Ni-based alloy plate of the present invention (unit: weight %) 67 | 68 | 69 | 70 | 71 | 72 |
|---|---|---|---|---|---|---|
| Cr | 32.1 | 22.8 | 20.6 | 21.7 | 17.3 | 20.5 |
| Mo | 8.3 | 11.9 | 20.0 | 20.1 | 17.1 | 17.5 |
| Ta | 5.26 | 4.15 | 2.11 | 2.06 | 2.15 | 1.22 |
| N | 0.0092 | 0.0121 | 0.0495 | 0.0511 | 0.0150 | 0.0183 |
| Si | 0.0826 | 0.0369 | 0.0425 | 0.0516 | 0.0224 | 0.0250 |
| Mn | 0.3253 | 0.4538 | 0.5256 | 0.5461 | 0.3825 | 0.3296 |
| C | 0.0053 | 0.0024 | 0.0038 | 0.0126 | 0.0086 | 0.0027 |
| Fe | 0.22 | — | — | — | 0.08 | 0.03 |
| B | — | — | — | — | — | — |
| Zr | 0.080 | — | — | — | 0.006 | — |
| Ca | — | — | — | — | — | 0.002 |
| Nb | — | — | — | — | — | — |
| W | — | — | — | — | 1.34 | — |
| Cu | 0.083 | — | — | — | — | 1.63 |
| Ti | — | — | — | — | — | — |
| Al | 0.10 | — | — | — | 0.04 | 0.02 |
| Co | 1.58 | — | — | — | 1.55 | — |
| V | — | — | — | — | — | 0.16 |
| Hf | 0.26 | — | — | — | 1.06 | 0.18 |
| Re | 0.04 | — | — | — | — | 1.53 |
| Os, Pt | Pt:0.21 | — | — | — | — | — |
| Pd, Ru | Ru:0.33 | — | — | — | — | — |
| La, Ce, Y | — | La:0.05 | Ce:0.04 | Y:0.06 | — | — |
| Ni + imp | bal. | bal. | bal. | bal. | bal. | bal. |

(Note: imp represents unavoidable impurities)

TABLE 13

| element | Comparative Ni-based alloy plates (unit: weight %) 1 | 2 | 3 | 4 | 5 | 6 |
|---|---|---|---|---|---|---|
| Cr | 14.5* | 35.4* | 30.1 | 18.4 | 21.6 | 20.9 |
| Mo | 20.2 | 6.4 | 5.6* | 24.3* | 22.1 | 19.6 |
| Cr + Mo | 34.7 | 41.8 | 35.7 | 42.7 | 43.7* | 40.5 |
| Ta | 3.26 | 6.97 | 2.96 | 1.28 | 2.25 | 0.98* |
| N | 0.0211 | 0.0405 | 0.0422 | 0.0365 | 0.0292 | 0.0191 |

TABLE 13-continued

| element | Comparative Ni-based alloy plates (unit: weight %) 1 | 2 | 3 | 4 | 5 | 6 |
|---|---|---|---|---|---|---|
| Si | 0.0932 | 0.0825 | 0.0516 | 0.0421 | 0.0386 | 0.0392 |
| Mn | 0.2457 | 0.1653 | 0.4281 | 0.3625 | 0.0292 | 0.0573 |
| C | 0.0114 | 0.0087 | 0.0092 | 0.0087 | 0.0071 | 0.0088 |
| Fe | 0.19 | 0.07 | 0.09 | 1.27 | — | 2.31 |
| B | 0.007 | — | — | — | — | 0.008 |
| Zr | — | 0.009 | — | — | — | — |
| Ca | — | — | 0.002 | — | — | — |
| Nb | — | — | — | — | — | — |
| W | — | — | — | — | — | — |
| Cu | — | — | — | — | — | — |
| Ti | — | — | — | — | — | — |
| Al | — | — | — | — | — | — |
| Co | — | — | — | — | — | — |
| V | — | — | — | — | — | — |
| Hf | — | — | — | — | — | — |
| Re | — | — | — | — | — | — |
| Ni + imp | bal. | bal. | bal. | bal. | bal. | bal. |

(Note: "imp" represents unavoidable impurities, and the values with an * are out of the range of the present invention.)

TABLE 14

| element | Comparative Ni-based alloy plates (unit: weight %) 7 | 8 | 9 | 10 | 11 | 12 |
|---|---|---|---|---|---|---|
| Cr | 19.3 | 20.1 | 20.3 | 21.5 | 19.1 | 19.4 |
| Mo | 15.7 | 22.7 | 19.8 | 21.2 | 20.8 | 21.0 |
| Cr + Mo | 34.9 | 42.9 | 40.1 | 42.7 | 39.9 | 40.4 |
| Ta | 8.33* | 2.83 | 1.85 | 1.38 | 1.66 | 1.89 |
| N | 0.0275 | —* | 0.1156* | 0.0651 | 0.0361 | 0.0351 |
| Si | 0.0275 | 0.0437 | 0.0420 | 0.3243* | 0.0735 | 0.0551 |
| Mn | 0.0239 | 0.0128 | 0.5956 | 0.9212 | 3.4526* | 0.1583 |
| C | 0.0136 | 0.0256 | 0.0467 | 0.0097 | 0.0028 | 0.3215* |
| Fe | — | — | 0.81 | — | — | — |
| B | — | — | 0.006 | — | — | — |
| Zr | — | — | — | — | — | — |
| Ca | — | — | — | — | — | — |
| Nb | — | — | — | — | — | — |
| W | — | — | — | — | — | — |
| Cu | — | — | — | — | — | — |
| Ti | — | — | — | — | — | — |
| Al | — | — | — | — | — | — |
| Co | — | — | — | — | — | — |
| V | — | — | — | — | — | — |
| Hf | — | — | — | — | — | — |
| Re | — | — | — | — | — | — |
| Ni + imp | bal. | bal. | bal. | bal. | bal. | bal. |

(Note: "imp" represents unavoidable impurities, and the values with an * are out of the range of the present invention.)

TABLE 15

| element | Comparative Ni-based alloy plates 13 | 14 | Conventional Ni-based alloy plates 1 | 2 | 3 | 4 |
|---|---|---|---|---|---|---|
| Cr | 18.5 | 19.3 | 30.1 | 21.5 | 16.1 | 21.5 |
| Mo | 21.2 | 19.6 | 20.3 | 9.0 | 16.2 | 13.2 |
| Cr + Mo | 39.7 | 38.9 | 50.7 | 30.5 | 32.3 | 34.7 |
| Ta | 2.01 | 1.88 | — | — | — | — |
| N | 0.0426 | 0.0305 | — | — | — | — |
| Si | 0.0438 | 0.0485 | — | — | — | — |
| Mn | 0.2895 | 0.4255 | — | — | — | — |
| C | 0.0166 | 0.0028 | — | — | — | — |

TABLE 15-continued

| element | Comparative Ni-based alloy plates 13 | 14 | Conventional Ni-based alloy plates 1 | 2 | 3 | 4 |
|---|---|---|---|---|---|---|
| Fe | 6.32* | 0.18 | — | 2.5 | 5.2 | — |
| B | — | 0.12* | — | — | — | — |
| Zr | — | — | — | — | — | — |
| Ca | — | — | — | — | — | — |
| Nb | — | — | — | 3.7 | — | — |
| W | — | — | — | — | 3.2 | 3.2 |
| Ni + imp | bal. | bal. | bal. | bal. | bal. | bal. |

(Note: "imp" represents unavoidable impurities, and the values with an * are out of the range of the present invention.)

TABLE 16

| type | | hot working workability: deformation resistance under 1100° C. (kg/mm²) | hot working workability: elongation up to rupture under 800° C. (%) | anti-corrosion property: pitting | anti-corrosion property: depth of crevice corrosion (mm) |
|---|---|---|---|---|---|
| Ni-based alloy plate of the present invention | 1 | 18.7 | 52.6 | none | 0.08 |
| | 2 | 18.9 | 53.7 | none | 0.09 |
| | 3 | 19.7 | 56.4 | none | 0.13 |
| | 4 | 17.9 | 51.3 | none | 0.15 |
| | 5 | 18.6 | 53.8 | none | 0.17 |
| | 6 | 18.5 | 50.6 | none | 0.15 |
| | 7 | 18.9 | 50.9 | none | 0.14 |
| | 8 | 19.4 | 45.2 | none | 0.14 |
| | 9 | 18.3 | 51.2 | none | 0.15 |
| | 10 | 18.7 | 50.3 | none | 0.16 |
| | 11 | 18.6 | 49.2 | none | 0.14 |
| | 12 | 18.9 | 48.1 | none | 0.13 |
| | 13 | 19.2 | 49.5 | none | 0.13 |
| | 14 | 18.3 | 51.3 | none | 0.14 |
| | 15 | 18.7 | 53.1 | none | 0.18 |
| | 16 | 19.2 | 40.8 | none | 0.11 |

TABLE 17

| type | | hot working workability: deformation resistance under 1100° C. (kg/mm²) | hot working workability: elongation up to rupture under 800° C. (%) | anti-corrosion property: pitting | anti-corrosion property: depth of crevice corrosion (mm) |
|---|---|---|---|---|---|
| Ni-based alloy plate of the present invention | 17 | 19.6 | 42.3 | none | 0.19 |
| | 18 | 17.5 | 58.7 | none | 0.13 |
| | 19 | 16.1 | 66.2 | none | 0.14 |
| | 20 | 16.3 | 67.1 | none | 0.12 |
| | 21 | 16.2 | 65.1 | none | 0.15 |
| | 22 | 16.4 | 68.3 | none | 0.19 |
| | 23 | 16.8 | 57.2 | none | 0.16 |
| | 24 | 16.7 | 58.9 | none | 0.18 |
| | 25 | 16.5 | 68.2 | none | 0.17 |
| | 26 | 16.2 | 70.3 | none | 0.18 |
| | 27 | 17.8 | 56.9 | none | 0.18 |
| | 28 | 17.1 | 58.7 | none | 0.19 |
| | 29 | 16.1 | 69.1 | none | 0.18 |
| | 30 | 15.9 | 70.4 | none | 0.19 |
| | 31 | 15.8 | 73.2 | none | 0.19 |
| | 32 | 18.4 | 50.2 | none | 0.19 |

TABLE 18

| type | | hot working workability: deformation resistance under 1100° C. (kg/mm²) | hot working workability: elongation up to rupture under 800° C. (%) | anti-corrosion property: pitting | anti-corrosion property: depth of crevice corrosion (mm) |
|---|---|---|---|---|---|
| Ni-based alloy plate of the present invention | 33 | 17.8 | 55.4 | none | 0.16 |
| | 34 | 17.9 | 53.9 | none | 0.18 |
| | 35 | 18.1 | 57.3 | none | 0.08 |
| | 36 | 18.3 | 58.2 | none | 0.07 |
| | 37 | 16.7 | 56.6 | non | 0.15 |
| | 38 | 17.5 | 57.8 | none | 0.11 |
| | 39 | 18.4 | 56.7 | none | 0.12 |
| | 40 | 17.8 | 49.9 | none | 0.07 |
| | 41 | 17.9 | 47.3 | none | 0.08 |
| | 42 | 15.8 | 46.2 | none | 0.09 |
| | 43 | 18.8 | 61.2 | none | 0.18 |
| | 44 | 18.9 | 60.3 | none | 0.19 |
| | 45 | 18.3 | 62.2 | none | 0.15 |
| | 46 | 18.5 | 50.1 | none | 0.14 |
| | 47 | 17.8 | 56.2 | none | 0.18 |
| | 48 | 18.9 | 51.3 | none | 0.19 |

TABLE 19

| type | | hot working workability: deformation resistance under 1100° C. (kg/mm²) | hot working workability: elongation up to rupture under 800° C. (%) | anti-corrosion property: pitting | anti-corrosion property: depth of crevice corrosion (mm) |
|---|---|---|---|---|---|
| Ni-based alloy plate of the present invention | 49 | 17.3 | 49.8 | none | 0.11 |
| | 50 | 18.9 | 50.7 | none | 0.12 |
| | 51 | 16.4 | 59.2 | none | 0.11 |
| | 52 | 19.1 | 51.3 | none | 0.14 |
| | 53 | 19.5 | 48.2 | none | 0.15 |
| | 54 | 17.9 | 56.2 | none | 0.11 |
| | 55 | 16.4 | 63.3 | none | 0.19 |
| | 56 | 16.7 | 57.2 | none | 0.10 |
| | 57 | 15.8 | 64.1 | none | 0.18 |
| | 58 | 18.5 | 50.5 | none | 0.09 |
| | 59 | 18.8 | 51.2 | none | 0.07 |
| | 60 | 18.5 | 50.8 | none | 0.11 |
| | 61 | 18.6 | 50.2 | none | 0.10 |
| | 62 | 17.3 | 56.9 | none | 0.15 |
| | 63 | 17.9 | 54.3 | none | 0.11 |
| | 64 | 17.1 | 56.2 | none | 0.13 |

TABLE 20

| type | | hot working workability: deformation resistance under 1100° C. (kg/mm²) | hot working workability: elongation up to rupture under 800° C. (%) | anti-corrosion property: pitting | anti-corrosion property: depth of crevice corrosion (mm) |
|---|---|---|---|---|---|
| Ni-based alloy plate of the present invention | 65 | 19.3 | 50.5 | none | 0.15 |
| | 66 | 19.1 | 50.3 | none | 0.15 |
| | 67 | 16.8 | 60.8 | none | 0.04 |
| | 68 | 17.2 | 55.9 | none | 0.17 |
| | 69 | 18.9 | 49.5 | none | 0.11 |
| | 70 | 19.2 | 49.2 | none | 0.13 |
| | 71 | 16.8 | 62.9 | none | 0.14 |
| | 72 | 16.2 | 54.3 | none | 0.08 |

TABLE 20-continued

| type | | hot working workability: deformation resistance under 1100° C. (kg/mm²) | hot working workability: elongation up to rupture under 800° C. (%) | anti-corrosion property: pitting | anti-corrosion property: depth of crevice corrosion (mm) |
|---|---|---|---|---|---|
| Comparative Ni-based alloy plates | 1 | 15.2 | 67.3 | present | 0.26 |
| | 2 | 20.1 | 45.6 | none | 0.21 |
| | 3 | 15.4 | 60.3 | present | 0.36 |
| | 4 | 21.6 | 39.8 | none | 0.15 |
| | 5 | 22.7 | 38.5 | none | 0.13 |
| | 6 | 18.9 | 45.6 | present | 0.38 |
| | 7 | 21.9 | 39.6 | none | 0.18 |
| | 8 | 20.5 | 38.5 | none | 0.11 |

TABLE 21

| type | | hot working workability: deformation resistance under 1100° C. (kg/mm²) | hot working workability: elongation up to rupture under 800° C. (%) | anti-corrosion property: pitting | anti-corrosion property: depth of crevice corrosion (mm) |
|---|---|---|---|---|---|
| Comparative Ni-based alloy plate | 9 | 22.9 | 20.5 | none | 0.18 |
| | 10 | 19.2 | 38.3 | none | 0.18 |
| | 11 | 18.7 | 43.8 | present | 0.21 |
| | 12 | 21.8 | 37.6 | none | 0.18 |
| | 13 | 17.7 | 55.7 | present | 0.22 |
| | 14 | 19.3 | 38.8 | none | 0.17 |
| Conventional Ni-based alloy plate | 1 | 29.8 | 8 | none | 0.02 |
| | 2 | 16.4 | 62 | present | 1.18 |
| | 3 | 19.1 | 65 | present | 0.88 |
| | 4 | 8.5 | 60 | present | 0.71 |

TABLE 22

| element | Ni-based alloy plate of the present invention (unit: weight %) 73 | 74 | 75 | 76 | 77 | 78 |
|---|---|---|---|---|---|---|
| Cr | 17.1 | 21.8 | 19.8 | 21.6 | 18.2 | 19.5 |
| Mo | 21.6 | 20.1 | 20.0 | 18.1 | 22.9 | 19.8 |
| Ta | 1.94 | 1.83 | 2.20 | 2.22 | 1.28 | 1.21 |
| N | 0.0224 | 0.0326 | 0.0349 | 0.0132 | 0.0085 | 0.0054 |
| Mg | 0.0028 | 0.0226 | 0.0274 | 0.0039 | 0.0028 | 0.0141 |
| Si | 0.0427 | 0.0522 | 0.0586 | 0.0422 | 0.0297 | 0.0328 |
| Mn | 0.0143 | 0.2855 | 0.3050 | 0.3218 | 0.2051 | 0.2853 |
| C | 0.0139 | 0.0120 | 0.0044 | 0.0098 | 0.0101 | 0.0149 |
| Fe | — | — | — | — | — | — |
| B | — | — | — | — | — | — |
| Zr | — | — | — | — | — | — |
| Ca | — | — | — | — | — | — |
| Nb | — | — | — | — | — | — |
| W | — | — | — | — | — | — |
| Cu | — | — | — | — | — | — |
| Hf | — | — | — | — | — | — |
| Ti | — | — | — | — | — | — |
| Al | — | — | — | — | — | — |
| Co | — | — | — | — | — | — |
| V | — | — | — | — | — | — |
| Ni + imp | bal. | bal. | bal. | bal. | bal. | bal. |

(Note: "imp" represents unavoidable impurities.)

TABLE 23

| element | Ni-based alloy plate of the present invention (unit: weight %) 79 | 80 | 81 | 82 | 83 | 84 |
|---|---|---|---|---|---|---|
| Cr | 20.2 | 18.4 | 19.3 | 20.2 | 21.4 | 20.7 |
| Mo | 19.6 | 22.2 | 21.4 | 20.1 | 19.6 | 18.4 |
| Ta | 3.47 | 2.05 | 2.08 | 2.19 | 2.38 | 1.97 |
| N | 0.0629 | 0.0018 | 0.0492 | 0.0315 | 0.0121 | 0.0092 |
| Mg | 0.0187 | 0.0098 | 0.0123 | 0.0015 | 0.0294 | 0.0103 |
| Si | 0.0625 | 0.0381 | 0.0349 | 0.0203 | 0.0057 | 0.0956 |
| Mn | 0.3926 | 0.0854 | 0.0458 | 0.0488 | 0.1219 | 0.1668 |
| C | 0.0075 | 0.0039 | 0.0053 | 0.0187 | 0.0115 | 0.0082 |
| Fe | — | — | — | — | — | — |
| B | — | — | — | — | — | — |
| Zr | — | — | — | — | — | — |
| Ca | — | — | — | — | — | — |
| Nb | — | — | — | — | — | — |
| W | — | — | — | — | — | — |
| Cu | — | — | — | — | — | — |
| Hf | — | — | — | — | — | — |
| Ti | — | — | — | — | — | — |
| Al | — | — | — | — | — | — |
| Co | — | — | — | — | — | — |
| V | — | — | — | — | — | — |
| Ni + imp | bal. | bal. | bal. | bal. | bal. | bal. |

(Note: "imp" represents unavoidable impurities.)

TABLE 24

| element | Ni-based alloy plate of the present invention (unit: weight %) 85 | 86 | 87 | 88 | 89 | 90 |
|---|---|---|---|---|---|---|
| Cr | 17.9 | 18.4 | 15.2 | 34.8 | 23.7 | 16.3 |
| Mo | 21.0 | 19.7 | 20.4 | 7.6 | 6.1 | 24.8 |
| Ta | 2.34 | 2.85 | 3.82 | 6.65 | 7.83 | 1.14 |
| N | 0.0086 | 0.0053 | 0.0244 | 0.0181 | 0.0293 | 0.0359 |
| Mg | 0.0164 | 0.0243 | 0.0114 | 0.0205 | 0.0224 | 0.0138 |
| Si | 0.0984 | 0.0055 | 0.0427 | 0.0834 | 0.0856 | 0.0427 |
| Mn | 0.4943 | 0.2734 | 0.3725 | 0.4292 | 0.2256 | 0.0281 |
| C | 0.0128 | 0.0193 | 0.0083 | 0.0112 | 0.0072 | 0.0154 |
| Fe | — | — | — | — | — | — |
| B | — | — | — | — | — | — |
| Zr | — | — | — | — | — | — |
| Ca | — | — | — | — | — | — |
| Nb | — | — | — | — | — | — |
| W | — | — | — | — | — | — |
| Cu | — | — | — | — | — | — |
| Hf | — | — | — | — | — | — |
| Ti | — | — | — | — | — | — |
| Al | — | — | — | — | — | — |
| Co | — | — | — | — | — | — |
| V | — | — | — | — | — | — |
| Ni + imp | bal. | bal. | bal. | bal. | bal. | bal. |

(Note: "imp" represents unavoidable impurities.)

TABLE 25

| element | Ni-based alloy plate of the present invention (unit: weight %) 91 | 92 | 93 | 94 | 95 | 96 |
|---|---|---|---|---|---|---|
| Cr | 19.6 | 18.3 | 19.2 | 17.6 | 21.1 | 20.8 |
| Mo | 21.8 | 20.5 | 20.8 | 21.2 | 19.5 | 19.4 |
| Ta | 1.12 | 7.93 | 1.93 | 1.55 | 2.12 | 2.03 |
| N | 0.0471 | 0.0032 | 0.0005 | 0.0462 | 0.0338 | 0.0485 |
| Mg | 0.0090 | 0.0291 | 0.0118 | 0.0072 | 0.0006 | 0.2954 |
| Si | 0.0489 | 0.0225 | 0.0743 | 0.0376 | 0.0155 | 0.0091 |
| Mn | 0.3521 | 0.0385 | 0.0135 | 0.0372 | 0.0927 | 0.1387 |
| C | 0.0121 | 0.0098 | 0.0105 | 0.0167 | 0.0044 | 0.0063 |
| Fe | — | — | — | — | — | — |
| B | — | — | — | — | — | — |
| Zr | — | — | — | — | — | — |

TABLE 25-continued

| element | Ni-based alloy plate of the present invention (unit: weight %) 91 | 92 | 93 | 94 | 95 | 96 |
|---|---|---|---|---|---|---|
| Ca | — | — | — | — | — | — |
| Nb | — | — | — | — | — | — |
| W | — | — | — | — | — | — |
| Cu | — | — | — | — | — | — |
| Hf | — | — | — | — | — | — |
| Ti | — | — | — | — | — | — |
| Al | — | — | — | — | — | — |
| Co | — | — | — | — | — | — |
| V | — | — | — | — | — | — |
| Ni + imp | bal. | bal. | bal. | bal. | bal. | bal. |

(Note: "imp" represents unavoidable impurities.)

TABLE 26

| element | Ni-based alloy plate of the present invention (unit: weight %) 97 | 98 | 99 | 100 | 101 | 102 |
|---|---|---|---|---|---|---|
| Cr | 20.4 | 19.9 | 18.3 | 19.6 | 19.6 | 19.7 |
| Mo | 19.1 | 20.8 | 21.2 | 21.4 | 18.5 | 20.1 |
| Ta | 1.80 | 1.84 | 2.09 | 2.20 | 1.87 | 2.02 |
| N | 0.0230 | 0.0054 | 0.0119 | 0.0251 | 0.0285 | 0.0309 |
| Mg | 0.0132 | 0.0105 | 0.0239 | 0.0281 | 0.0103 | 0.0029 |
| Si | 0.2934 | 0.0562 | 0.0442 | 0.0276 | 0.0832 | 0.0726 |
| Mn | 0.2895 | 2.9862 | 0.1382 | 0.0835 | 0.4255 | 0.3463 |
| C | 0.0129 | 0.0147 | 0.0988 | 0.0049 | 0.0187 | 0.0105 |
| Fe | — | — | — | — | 5.85 | — |
| B | — | — | — | — | — | 0.0974 |
| Zr | — | — | — | — | — | — |
| Ca | — | — | — | — | — | — |
| Nb | — | — | — | — | — | — |
| W | — | — | — | — | — | — |
| Cu | — | — | — | — | — | — |
| Hf | — | — | — | — | — | — |
| Ti | — | — | — | — | — | — |
| Al | — | — | — | — | — | — |
| Co | — | — | — | — | — | — |
| V | — | — | — | — | — | — |
| Ni + imp | bal. | bal. | bal. | bal. | bal. | bal. |

(Note: "imp" represents unavoidable impurities.)

TABLE 27

| element | Ni-based alloy plate of the present invention (unit: weight %) 103 | 104 | 105 | 106 | 107 | 108 |
|---|---|---|---|---|---|---|
| Cr | 19.8 | 19.7 | 19.8 | 20.2 | 19.9 | 20.1 |
| Mo | 19.2 | 20.5 | 20.3 | 19.7 | 20.4 | 19.2 |
| Ta | 1.84 | 1.76 | 2.04 | 1.93 | 1.82 | 2.25 |
| N | 0.0178 | 0.0315 | 0.0051 | 0.0188 | 0.0276 | 0.0242 |
| Mg | 0.0045 | 0.0073 | 0.0185 | 0.0270 | 0.0139 | 0.0273 |
| Si | 0.0358 | 0.0379 | 0.0147 | 0.0088 | 0.0093 | 0.0147 |
| Mn | 0.0295 | 0.0133 | 0.0058 | 0.0295 | 0.1395 | 0.3526 |
| C | 0.0129 | 0.0182 | 0.0027 | 0.0091 | 0.0105 | 0.0134 |
| Fe | — | — | 0.02 | 0.58 | 0.84 | — |
| B | — | — | 0.0017 | — | — | 0.0275 |
| Zr | — | 0.0982 | — | — | 0.0085 | — |
| Ca | 0.0094 | — | — | 0.0015 | — | 0.0032 |
| Nb | — | — | — | — | — | — |
| W | — | — | — | — | — | — |
| Cu | — | — | — | — | — | — |
| Hf | — | — | — | — | — | — |
| Ti | — | — | — | — | — | — |
| Al | — | — | — | — | — | — |

TABLE 27-continued

| element | Ni-based alloy plate of the present invention (unit: weight %) 103 | 104 | 105 | 106 | 107 | 108 |
|---|---|---|---|---|---|---|
| Co | — | — | — | — | — | — |
| V | — | — | — | — | — | — |
| Ni + imp | bal. | bal. | bal. | bal. | bal. | bal. |

(Note: "imp" represents unavoidable impurities.)

TABLE 28

| element | Ni-based alloy plate of the present invention (unit: weight %) 109 | 110 | 111 | 112 | 113 | 114 |
|---|---|---|---|---|---|---|
| Cr | 20.4 | 19.6 | 19.8 | 20.0 | 20.2 | 20.3 |
| Mo | 20.3 | 19.4 | 20.2 | 20.3 | 19.7 | 20.8 |
| Ta | 2.09 | 2.11 | 1.89 | 1.73 | 1.85 | 2.29 |
| N | 0.0276 | 0.0130 | 0.0240 | 0.0284 | 0.0225 | 0.0134 |
| Mg | 0.0198 | 0.0115 | 0.0218 | 0.0244 | 0.0175 | 0.0127 |
| Si | 0.0285 | 0.0635 | 0.0678 | 0.0556 | 0.0398 | 0.0275 |
| Mn | 0.4566 | 0.0288 | 0.0125 | 0.0259 | 0.0105 | 0.0224 |
| C | 0.0116 | 0.0198 | 0.0155 | 0.0120 | 0.0177 | 0.0181 |
| Fe | — | — | 1.52 | 2.24 | 1.54 | — |
| B | 0.0342 | — | 0.0074 | — | 0.0135 | 0.0042 |
| Zr | 0.0127 | 0.0088 | — | 0.0143 | 0.0192 | 0.0083 |
| Ca | — | 0.0045 | 0.0027 | 0.0035 | — | 0.0055 |
| Nb | — | — | — | — | — | — |
| W | — | — | — | — | — | — |
| Cu | — | — | — | — | — | — |
| Hf | — | — | — | — | — | — |
| Ti | — | — | — | — | — | — |
| Al | — | — | — | — | — | — |
| Co | — | — | — | — | — | — |
| V | — | — | — | — | — | — |
| Ni + imp | bal. | bal. | bal. | bal. | bal. | bal. |

(Note: "imp" represents unavoidable impurities.)

TABLE 29

| element | Ni-based alloy plate of the present invention (unit: weight %) 115 | 116 | 117 | 118 | 119 | 120 |
|---|---|---|---|---|---|---|
| Cr | 19.3 | 19.2 | 19.8 | 20.2 | 21.0 | 20.5 |
| Mo | 20.7 | 17.2 | 16.5 | 16.3 | 18.4 | 20.8 |
| Ta | 1.75 | 1.83 | 2.92 | 2.38 | 2.26 | 1.89 |
| N | 0.0172 | 0.0155 | 0.0184 | 0.0247 | 0.0154 | 0.0133 |
| Mg | 0.0152 | 0.0246 | 0.0084 | 0.0052 | 0.0138 | 0.0201 |
| Si | 0.0752 | 0.0621 | 0.0373 | 0.0262 | 0.0054 | 0.0213 |
| Mn | 0.3564 | 0.0293 | 0.0180 | 0.1724 | 0.0838 | 0.0732 |
| C | 0.0119 | 0.0077 | 1.0082 | 0.0173 | 0.0166 | 0.0180 |
| Fe | 0.01 | — | — | — | — | 0.08 |
| B | 0.0015 | — | — | — | — | — |
| Zr | 0.0013 | — | — | — | — | — |
| Ca | 0.0014 | — | — | — | — | — |
| Nb | — | 0.92 | — | — | — | 0.13 |
| W | — | — | 3.95 | — | — | 0.14 |
| Cu | — | — | — | 3.92 | — | — |
| Hf | — | — | — | — | 1.96 | — |
| Ti | — | — | — | — | — | — |
| Al | — | — | — | — | — | — |
| Co | — | — | — | — | — | — |
| V | — | — | — | — | — | — |
| Ni + imp | bal. | bal. | bal. | bal. | bal. | bal. |

(Note: "imp" represents unavoidable impurities.)

TABLE 30

| element | Ni-based alloy plate of the present invention (unit: weight %) 121 | 122 | 123 | 124 | 125 | 126 |
|---|---|---|---|---|---|---|
| Cr | 20.8 | 19.9 | 19.6 | 19.7 | 20.1 | 20.2 |
| Mo | 19.2 | 20.3 | 19.5 | 20.9 | 19.7 | 19.8 |
| Ta | 1.94 | 1.99 | 1.87 | 2.15 | 2.27 | 2.09 |
| N | 0.0208 | 0.0421 | 0.0270 | 0.0332 | 0.0309 | 0.0394 |
| Mg | 0.0155 | 0.0287 | 0.0098 | 0.0139 | 0.0162 | 0.0130 |
| Si | 0.0356 | 0.0511 | 0.0435 | 0.0048 | 0.0019 | 0.0209 |
| Mn | 0.1518 | 0.2360 | 0.1829 | 0.0327 | 0.0225 | 0.0138 |
| C | 0.0077 | 0.0098 | 0.0085 | 0.0191 | 0.0148 | 0.0092 |
| Fe | — | — | — | — | — | — |
| B | 0.0045 | — | — | — | — | — |
| Zr | — | — | 0.0038 | — | — | — |
| Ca | — | 0.0022 | — | — | — | — |
| Nb | — | — | 0.19 | — | — | — |
| W | 0.12 | — | — | — | — | — |
| Cu | 0.11 | 0.28 | — | — | — | — |
| Hf | — | 0.35 | 0.14 | — | — | — |
| Ti | — | — | — | 0.77 | — | — |
| Al | — | — | — | — | 0.78 | — |
| Co | — | — | — | — | — | 4.95 |
| V | — | — | — | — | — | — |
| Ni + imp | bal. | bal. | bal. | bal. | bal. | bal. |

(Note: "imp" represents unavoidable impurities.)

TABLE 31

| element | Ni-based alloy plate of the present invention (unit: weight %) 127 | 128 | 129 | 130 | 131 | 132 |
|---|---|---|---|---|---|---|
| Cr | 19.7 | 20.8 | 20.2 | 20.5 | 20.3 | 19.2 |
| Mo | 20.5 | 20.4 | 20.5 | 20.8 | 20.6 | 19.5 |
| Ta | 2.10 | 1.85 | 1.93 | 1.79 | 2.06 | 1.80 |
| N | 0.0135 | 0.0170 | 0.0024 | 0.0054 | 0.0088 | 0.0125 |
| Mg | 0.0165 | 0.0129 | 0.0223 | 0.0256 | 0.0145 | 0.0236 |
| Si | 0.0156 | 0.0024 | 0.0557 | 0.0438 | 0.0296 | 0.0210 |
| Mn | 0.0927 | 0.4238 | 0.4325 | 0.3863 | 0.0284 | 0.0363 |
| C | 0.0083 | 0.0125 | 0.0115 | 0.0104 | 0.0080 | 0.0106 |
| Fe | — | 0.92 | — | — | — | 2.25 |
| B | — | — | 0.0041 | — | — | — |
| Zr | — | — | — | — | 0.0033 | — |
| Ca | — | — | — | 0.0027 | — | — |
| Nb | — | 0.25 | — | — | — | 0.19 |
| W | — | — | 0.45 | — | — | — |
| Cu | — | — | — | 0.33 | — | — |
| Hf | — | — | — | — | 0.28 | — |
| Ti | — | 0.06 | — | — | 0.09 | — |
| Al | — | 0.02 | 0.04 | — | — | — |
| Co | — | — | 0.13 | 0.29 | — | — |
| V | 0.48 | — | — | 0.12 | 0.18 | — |
| Ni + imp | bal. | bal. | bal. | bal. | bal. | bal. |

(Note: "imp" represents unavoidable impurities.)

TABLE 32

| element | Ni-based alloy plate of the present invention (unit: weight %) 133 | 134 | 135 | 136 | 137 | 138 |
|---|---|---|---|---|---|---|
| Cr | 17.9 | 18.2 | 18.4 | 19.6 | 19.5 | 18.7 |
| Mo | 18.6 | 18.9 | 19.1 | 19.3 | 18.4 | 18.2 |
| Ta | 1.81 | 1.34 | 2.03 | 2.22 | 2.56 | 2.18 |
| N | 0.0018 | 0.0078 | 0.0173 | 0.0215 | 0.0089 | 0.0110 |
| Mg | 0.0015 | 0.0132 | 0.0161 | 0.0213 | 0.0085 | 0.0155 |
| Si | 0.0832 | 0.0775 | 0.0655 | 0.0542 | 0.0331 | 0.0448 |
| Mn | 0.1283 | 0.0835 | 0.0721 | 0.0085 | 0.0134 | 0.0155 |
| C | 0.0133 | 0.0029 | 0.0018 | 0.0052 | 0.0043 | 0.0085 |
| Fe | 0.85 | 0.62 | 1.15 | 1.28 | 1.33 | 1.49 |
| B | — | — | — | — | — | — |
| Zr | — | — | — | — | — | — |

TABLE 32-continued

| element | Ni-based alloy plate of the present invention (unit: weight %) 133 | 134 | 135 | 136 | 137 | 138 |
|---|---|---|---|---|---|---|
| Ca | — | — | — | — | — | — |
| Nb | — | — | — | — | — | — |
| W | 1.23 | — | — | — | — | — |
| Cu | — | 1.55 | — | — | — | — |
| Hf | — | — | 0.82 | — | — | — |
| Ti | — | — | — | 0.14 | — | — |
| Al | — | — | — | — | 0.18 | — |
| Co | — | — | — | — | — | 0.56 |
| V | — | — | — | — | — | — |
| Ni + imp | bal. | bal. | bal. | bal. | bal. | bal. |

(Note: "imp" represents unavoidable impurities.)

TABLE 33

| element | Ni-based alloy plate of the present invention (unit: weight %) 139 | 140 | 141 | 142 | 143 | 144 |
|---|---|---|---|---|---|---|
| Cr | 18.9 | 17.7 | 18.3 | 18.5 | 18.7 | 19.2 |
| Mo | 19.5 | 20.2 | 19.1 | 20.3 | 20.6 | 20.0 |
| Ta | 1.43 | 1.55 | 1.78 | 1.95 | 1.28 | 1.46 |
| N | 0.0028 | 0.0133 | 0.0115 | 0.0092 | 0.0456 | 0.0359 |
| Mg | 0.0225 | 0.0181 | 0.0235 | 0.0080 | 0.0077 | 0.0119 |
| Si | 0.0820 | 0.0735 | 0.0098 | 0.0332 | 0.0611 | 0.0090 |
| Mn | 0.1443 | 0.0826 | 0.2234 | 0.0186 | 0.0732 | 0.0563 |
| C | 0.0131 | 0.0029 | 0.0086 | 0.0112 | 0.0073 | 0.0042 |
| Fe | 1.25 | 2.56 | 2.48 | — | — | 0.02 |
| B | — | — | — | — | — | 0.002 |
| Zr | — | — | — | — | — | 0.002 |
| Ca | — | — | — | — | — | 0.001 |
| Nb | — | — | 0.26 | — | — | 0.11 |
| W | — | — | 0.43 | — | — | 0.14 |
| Cu | — | — | 0.55 | 0.88 | — | 0.11 |
| Hf | — | — | 0.26 | 0.31 | 0.28 | 0.12 |
| Ti | — | 0.13 | — | — | 0.11 | 0.07 |
| Al | — | 0.06 | — | — | — | 0.02 |
| Co | — | 0.9 | — | — | 0.25 | 0.13 |
| V | 0.18 | 0.21 | — | 0.12 | — | 0.11 |
| Ni + imp | bal. | bal. | bal. | bal. | bal. | bal. |

(Note: "imp" represents unavoidable impurities.)

TABLE 34

| element | Comparative Ni-based alloy plates (unit: weight %) 15 | 16 | 17 | 18 | 19 | 20 |
|---|---|---|---|---|---|---|
| Cr | 14.5* | 35.6* | 29.8 | 17.4 | 20.1 | 19.8 |
| Mo | 20.1 | 6.3 | 5.4* | 25.6* | 19.7 | 15.4 |
| Ta | 3.30 | 6.82 | 3.03 | 1.31 | 0.91* | 8.52* |
| N | 0.0255 | 0.0356 | 0.0428 | 0.0283 | 0.0193 | 0.0354 |
| Mg | 0.0785 | 0.0246 | 0.0180 | 0.0058 | 0.0173 | 0.0059 |
| Si | 0.0804 | 0.0529 | 0.0618 | 0.0742 | 0.0121 | 0.0388 |
| Mn | 0.2881 | 0.1825 | 0.3935 | 0.4351 | 0.0565 | 0.0745 |
| C | 0.0105 | 0.0098 | 0.0125 | 0.0143 | 0.0044 | 0.0075 |
| Fe | — | — | — | — | — | — |
| B | — | — | — | — | — | — |
| Zr | — | — | — | — | — | — |
| Ca | — | — | — | — | — | — |
| Nb | — | — | — | — | — | — |
| W | — | — | — | — | — | — |
| Cu | — | — | — | — | — | — |
| Hf | — | — | — | — | — | — |
| Ti | — | — | — | — | — | — |

TABLE 34-continued

| element | Comparative Ni-based alloy plates (unit: weight %) 15 | 16 | 17 | 18 | 19 | 20 |
|---|---|---|---|---|---|---|
| Al | — | — | — | — | — | — |
| Co | — | — | — | — | — | — |
| V | — | — | — | — | — | — |
| Ni + imp | bal. | bal. | bal. | bal. | bal. | bal. |

(Note: "imp" represents unavoidable impurities, and the values with an * are out of the range of the present invention.)

TABLE 35

| element | Comparative Ni-based alloy plates (unit: weight %) 21 | 22 | 23 | 24 | 25 |
|---|---|---|---|---|---|
| Cr | 20.4 | 20.7 | 20.5 | 21.5 | 19.2 |
| Mo | 22.3 | 19.6 | 21.1 | 21.2 | 20.7 |
| Ta | 2.88 | 1.95 | 2.59 | 1.38 | 1.73 |
| N | —* | 0.12* | 0.0557 | 0.0651 | 0.0365 |
| Mg | 0.0225 | 0.0170 | 0.33* | 0.0295 | 0.0145 |
| Si | 0.0225 | 0.0595 | 0.0146 | 0.32* | 0.0733 |
| Mn | 0.0384 | 0.2765 | 0.4829 | 0.8356 | 3.25* |
| C | 0.0144 | 0.0049 | 0.0159 | 0.0079 | 0.0028 |
| Fe | — | — | — | — | — |
| B | — | — | — | — | — |
| Zr | — | — | — | — | — |
| Ca | — | — | — | — | — |
| Nb | — | — | — | — | — |
| W | — | — | — | — | — |
| Cu | — | — | — | — | — |
| Hf | — | — | — | — | — |
| Ti | — | — | — | — | — |
| Al | — | — | — | — | — |
| Co | — | — | — | — | — |
| V | — | — | — | — | — |
| Ni + imp | bal. | bal. | bal. | bal. | bal. |

(Note: "imp" represents unavoidable impurities, and the values with an * are out of the range of the present invention.)

TABLE 36

| element | Comparative Ni-based alloy plates 26 | 27 | Conventional Ni-based alloy plates 1 | 2 | 3 | 4 |
|---|---|---|---|---|---|---|
| Cr | 19.8 | 19.3 | 30.1 | 21.5 | 16.1 | 21.5 |
| Mo | 20.8 | 19.6 | 20.3 | 9.0 | 16.2 | 13.2 |
| Ta | 1.88 | 1.87 | — | — | — | — |
| N | 0.0352 | 0.0305 | — | — | — | — |
| Mg | 0.0145 | 0.0177 | — | — | — | — |
| Si | 0.0829 | 0.0485 | — | — | — | — |
| Mn | 0.1411 | 0.4255 | — | — | — | — |
| C | 0.1105* | 0.0028 | — | — | — | — |
| Fe | — | 6.33* | — | 2.5 | 5.2 | — |
| B | — | — | — | — | — | — |
| Zr | — | — | — | — | — | — |
| Ca | — | — | — | — | — | — |
| Nb | — | — | — | 3.7 | — | — |
| W | — | — | — | — | 3.2 | 3.2 |
| Ni + imp | bal. | bal. | bal. | bal. | bal. | bal. |

(Note: "imp" represents unavoidable impurities, and the values with an * are out of the range of the present invention.)

TABLE 37

| type | | hot working workability: deformation resistance under 1100° C. (kg/mm²) | hot working workability: elongation up to rupture under 800° C. (%) | anti-corrosion property: pitting | anti-corrosion property: depth of crevice corrosion (mm) |
|---|---|---|---|---|---|
| Ni-based alloy plate of the present invention | 73 | 18.6 | 54.8 | none | 0.08 |
| | 74 | 18.4 | 51.6 | none | 0.07 |
| | 75 | 19.2 | 48.6 | none | 0.09 |
| | 76 | 18.3 | 49.2 | none | 0.11 |
| | 77 | 18.2 | 50.5 | none | 0.12 |
| | 78 | 19.4 | 50.3 | none | 0.10 |
| | 79 | 19.0 | 49.5 | none | 0.14 |
| | 80 | 18.8 | 48.2 | none | 0.14 |
| | 81 | 18.9 | 52.5 | none | 0.12 |
| | 82 | 19.1 | 51.1 | none | 0.14 |
| | 83 | 18.8 | 50.2 | none | 0.10 |
| | 84 | 19.2 | 51.3 | none | 0.11 |
| | 85 | 19.8 | 50.9 | none | 0.09 |
| | 86 | 19.4 | 49.6 | none | 0.10 |
| | 87 | 18.8 | 52.6 | none | 0.17 |
| | 88 | 18.0 | 58.1 | none | 0.18 |

TABLE 38

| type | | hot working workability: deformation resistance under 1100° C. (kg/mm²) | hot working workability: elongation up to rupture under 800° C. (%) | anti-corrosion property: pitting | anti-corrosion property: depth of crevice corrosion (mm) |
|---|---|---|---|---|---|
| Ni-based alloy plate of the present invention | 89 | 18.4 | 55.4 | none | 0.16 |
| | 90 | 19.1 | 44.2 | none | 0.14 |
| | 91 | 18.3 | 50.8 | none | 0.13 |
| | 92 | 18.5 | 43.6 | none | 0.15 |
| | 93 | 19.3 | 51.2 | none | 0.18 |
| | 94 | 19.0 | 50.0 | none | 0.16 |
| | 95 | 18.5 | 49.7 | none | 0.17 |
| | 96 | 19.4 | 52.3 | none | 0.17 |
| | 97 | 18.6 | 49.1 | none | 0.18 |
| | 98 | 18.1 | 48.7 | none | 0.18 |
| | 99 | 18.6 | 44.2 | none | 0.19 |
| | 100 | 18.5 | 52.6 | none | 0.13 |
| | 101 | 18.5 | 52.1 | none | 0.16 |
| | 102 | 18.4 | 50.6 | none | 0.15 |
| | 103 | 19.2 | 50.9 | none | 0.17 |
| | 104 | 18.6 | 49.8 | none | 0.15 |

TABLE 39

| type | | hot working workability: deformation resistance under 1100° C. (kg/mm²) | hot working workability: elongation up to rupture under 800° C. (%) | anti-corrosion property: pitting | anti-corrosion property: depth of crevice corrosion (mm) |
|---|---|---|---|---|---|
| Ni-based alloy plate of the present invention | 105 | 19.9 | 52.9 | none | 0.18 |
| | 106 | 18.1 | 51.1 | none | 0.13 |
| | 107 | 18.4 | 52.5 | none | 0.18 |
| | 108 | 18.4 | 51.3 | none | 0.17 |
| | 109 | 18.7 | 50.4 | none | 0.16 |
| | 110 | 19.4 | 52.3 | none | 0.17 |
| | 111 | 18.5 | 51.8 | none | 0.16 |
| | 112 | 18.0 | 49.5 | none | 0.16 |
| | 113 | 18.4 | 49.6 | none | 0.17 |
| | 114 | 18.9 | 48.8 | none | 0.18 |

TABLE 39-continued

| type | | hot working workability: deformation resistance under 1100° C. (kg/mm²) | hot working workability: elongation up to rupture under 800° C. (%) | anti-corrosion property: pitting | anti-corrosion property: depth of crevice corrosion (mm) |
|---|---|---|---|---|---|
| | 115 | 18.8 | 52.5 | none | 0.19 |
| | 116 | 18.2 | 48.8 | none | 0.18 |
| | 117 | 18.6 | 46.7 | none | 0.16 |
| | 118 | 19.2 | 46.5 | none | 0.17 |
| | 119 | 19.4 | 49.2 | none | 0.16 |
| | 120 | 19.0 | 48.8 | none | 0.16 |

TABLE 40

| type | | hot working workability: deformation resistance under 1100° C. (kg/mm²) | hot working workability: elongation up to rupture under 800° C. (%) | anti-corrosion property: pitting | anti-corrosion property: depth of crevice corrosion (mm) |
|---|---|---|---|---|---|
| Ni-based alloy plate of the present invention | 121 | 19.6 | 47.2 | none | 0.18 |
| | 122 | 19.4 | 48.1 | none | 0.14 |
| | 123 | 19.2 | 48.2 | none | 0.16 |
| | 124 | 19.8 | 49.5 | none | 0.17 |
| | 125 | 19.5 | 50.1 | none | 0.18 |
| | 126 | 19.5 | 44.5 | none | 0.15 |
| | 127 | 19.0 | 52.1 | none | 0.14 |
| | 128 | 18.9 | 50.3 | none | 0.16 |
| | 129 | 19.6 | 48.8 | none | 0.15 |
| | 130 | 19.8 | 46.5 | none | 0.14 |
| | 131 | 19.7 | 48.2 | none | 0.16 |
| | 132 | 18.8 | 44.6 | none | 0.15 |
| | 133 | 18.5 | 50.2 | none | 0.14 |
| | 134 | 18.6 | 50.1 | none | 0.14 |
| | 135 | 19.1 | 49.3 | none | 0.15 |
| | 136 | 19.3 | 48.1 | none | 0.13 |

TABLE 41

| type | | hot working workability: deformation resistance under 1100° C. (kg/mm²) | hot working workability: elongation up to rupture under 800° C. (%) | anti-corrosion property: pitting | anti-corrosion property: depth of crevice corrosion (mm) |
|---|---|---|---|---|---|
| Ni-based alloy plate of the present invention | 137 | 19.5 | 51.6 | none | 0.16 |
| | 138 | 19.6 | 52.1 | none | 0.17 |
| | 139 | 19.3 | 51.0 | none | 0.15 |
| | 140 | 19.2 | 49.8 | none | 0.15 |
| | 141 | 18.1 | 50.6 | none | 0.14 |
| | 142 | 19.9 | 51.3 | none | 0.14 |
| | 143 | 18.5 | 50.1 | none | 0.13 |
| | 144 | 18.7 | 50.9 | none | 0.12 |
| Comparative Ni-based alloy plate | 15 | 15.2 | 67.3 | present | 0.26 |
| | 16 | 20.2 | 45.8 | none | 0.21 |
| | 17 | 15.4 | 60.3 | present | 0.37 |
| | 18 | broken during rolling | — | — | — |
| | 19 | 18.9 | 45.6 | present | 0.38 |
| | 20 | 21.9 | 38.8 | none | 0.13 |
| | 21 | 20.5 | 38.4 | none | 0.11 |
| | 22 | 22.8 | 20.2 | present | 0.18 |

TABLE 42

| type | | hot working workability: deformation resistance under 1100° C. (kg/mm²) | hot working workability: elongation up to rupture under 800° C. (%) | anti-corrosion property: pitting | anti-corrosion property: depth of crevice corrosion (mm) |
|---|---|---|---|---|---|
| Comparative Ni-based alloy plate | 23 | broken during rolling | — | — | — |
| | 24 | 19.2 | 38.3 | none | 0.18 |
| | 25 | 18.7 | 43.8 | present | 0.25 |
| | 26 | 21.8 | 37.4 | none | 0.18 |
| | 27 | 18.6 | 38.9 | present | 0.21 |
| Conventional Ni-based alloy plate | 1 | 29.8 | 8 | none | 0.02 |
| | 2 | 16.4 | 62 | present | 1.18 |
| | 3 | 19.1 | 65 | present | 0.88 |
| | 4 | 18.5 | 60 | present | 0.21 |

TABLE 43

| type | | composition (weight %) (remaining portion: Ni and unavoidable impurities): Cr | Mo | Ta | Fe | Zr | B | Nb | W | Cu | Cr + Mo | [4Nb + W + Cu] | crack during hot working |
|---|---|---|---|---|---|---|---|---|---|---|---|---|---|
| Ni-based alloy plate of the present invention | 145 | 17.5 | 21.3 | 1.68 | 0.43 | — | — | — | — | — | 38.8 | — | none |
| | 146 | 18.1 | 23.4 | 1.04 | 0.87 | — | — | — | — | — | 41.5 | — | |
| | 147 | 19.6 | 20.8 | 1.84 | 0.03 | — | — | — | — | — | 40.4 | — | |
| | 148 | 18.8 | 21.2 | 2.21 | 3.33 | — | — | — | — | — | 40.0 | — | |
| | 149 | 19.2 | 23.6 | 1.64 | 0.85 | 0.003 | — | — | — | — | 42.8 | — | |
| | 150 | 20.2 | 22.6 | 2.02 | 1.89 | 0.004 | — | — | — | — | 42.8 | — | |
| | 151 | 19.5 | 22.9 | 2.98 | 0.05 | — | 0.002 | — | — | — | 42.4 | — | |
| | 152 | 20.8 | 21.2 | 1.85 | 3.82 | — | 0.005 | — | — | — | 42.0 | — | |
| | 153 | 20.6 | 22.3 | 1.42 | 0.02 | — | 0.005 | 0.13 | — | — | 42.9 | 0.52 | |
| | 154 | 21.3 | 21.1 | 3.49 | 0.56 | — | 0.005 | 0.39 | 0.18 | 0.20 | 42.4 | 1.94 | |

TABLE 44

| type | | composition (weight %) (remaining portion: Ni and unavoidable impurities): Cr | Mo | Ta | Fe | Zr | B | Nb | W | Cu | Cr + Mo | [4Nb + W + Cu] | crack during hot working |
|---|---|---|---|---|---|---|---|---|---|---|---|---|---|
| Ni-based alloy plate of the present invention | 155 | 19.3 | 19.1 | 3.32 | 0.05 | 0.005 | — | — | — | — | 38.4 | — | none |
| | 156 | 21.5 | 19.6 | 1.55 | 2.18 | — | 0.005 | — | — | 1.88 | 41.1 | 1.88 | |
| | 157 | 20.4 | 20.1 | 2.01 | 0.13 | 0.005 | — | 0.18 | — | — | 40.5 | 0.72 | |
| | 158 | 17.1 | 21.2 | 2.35 | 0.85 | 0.003 | 0.005 | — | 1.24 | — | 38.3 | 1.24 | |
| | 159 | 20.2 | 20.1 | 1.16 | 3.75 | 0.008 | — | — | 0.5 | — | 40.3 | 0.5 | |
| | 160 | 21.5 | 20.8 | 2.84 | 2.53 | — | 0.007 | — | 0.34 | — | 42.3 | 0.34 | |
| | 161 | 18.9 | 23.7 | 1.81 | 0.55 | 0.005 | 0.005 | — | — | 1.02 | 42.6 | 1.02 | |
| | 162 | 19.5 | 21.5 | 1.14 | 0.06 | 0.005 | — | 0.3 | — | — | 41.0 | 1.2 | |
| | 163 | 20.3 | 19.4 | 1.59 | 0.08 | — | 0.004 | — | 1.5 | — | 39.7 | 1.5 | |
| | 164 | 21.6 | 22.1 | 1.89 | 1.25 | 0.005 | — | — | — | 0.20 | 43.7 | 0.2 | |
| | 165 | 19.8 | 20.4 | 1.26 | 0.07 | — | 0.006 | 0.15 | 1.22 | — | 40.2 | 1.82 | |
| | 166 | 20.1 | 20.3 | 1.31 | 0.05 | — | 0.005 | 0.27 | — | 0.76 | 40.4 | 1.84 | |
| | 167 | 20.2 | 19.7 | 1.35 | 0.08 | 0.007 | 0.002 | — | 1.23 | 0.55 | 39.9 | 1.78 | |

TABLE 45

| type | | composition (weight %) (remaining portion: Ni and unavoidable impurities) | | | | | | | | | | | crack during hot working |
|---|---|---|---|---|---|---|---|---|---|---|---|---|---|
| | | Cr | Mo | Ta | Fe | Zr | B | Nb | W | Cu | Cr + Mo | [4Nb + W + Cu] | |
| Comparative Ni-based alloy plate | 28 | 22.9* | 23.1 | 2.08 | 0.03 | — | 0.005 | — | — | — | 46.0* | — | present |
| | 29 | 16.2* | 22.2 | 1.87 | 0.05 | 0.004 | — | — | — | — | 38.4 | — | none |
| | 30 | 18.4 | 25.5* | 1.89 | 1.22 | — | 0.003 | — | — | — | 43.9 | — | present |
| | 31 | 19.8 | 18.3* | 1.34 | 0.84 | — | — | 0.12 | — | — | 38.1 | 0.48 | none |
| | 32 | 18.9 | 21.9 | 4.0* | 0.03 | — | — | — | — | — | 40.8 | — | present |
| | 33 | 18.8 | 21.6 | 0.5* | 0.06 | — | — | — | — | — | 40.4 | — | none |
| | 34 | 19.7 | 20.1 | 2.67 | 0.005* | — | — | — | — | — | 39.8 | — | present |
| | 35 | 18.6 | 22.1 | 1.27 | 4.5* | — | — | — | — | — | 40.7 | — | none |
| | 36 | 21.3 | 21.2 | 3.33 | 0.89 | 0.015* | — | — | — | — | 42.5 | — | present |
| | 37 | 19.1 | 20.9 | 2.19 | 0.04 | — | 0.015* | — | — | — | 40.0 | — | present |

(Note: The values with an * are out of the range of the invention or preferred range.)

TABLE 46

| type | | composition (weight %) (remaining portion: Ni and unavoidable impurities) | | | | | | | | | | | crack during hot working |
|---|---|---|---|---|---|---|---|---|---|---|---|---|---|
| | | Cr | Mo | Ta | Fe | Zr | B | Nb | W | Cu | Cr + Mo | [4Nb + W + Cu] | |
| Comparative Ni-based alloy plate | 38 | 20.5 | 19.4 | 1.20 | 0.09 | 0.005 | — | 0.6* | — | — | 39.9 | 2.4* | present |
| | 39 | 19.6 | 19.1 | 1.13 | 0.05 | — | 0.005 | — | 2.5* | — | 38.7 | 2.5* | present |
| | 40 | 18.3 | 22.1 | 2.23 | 0.37 | 0.005 | — | — | — | 2.5* | 40.4 | 2.5* | present |
| | 41 | 21.8 | 23.4 | 3.08 | 0.03 | — | — | — | — | — | 45.2* | — | present |
| | 42 | 17.6 | 19.5 | 1.87 | 0.11 | — | — | — | — | — | 37.1* | — | present |
| | 43 | 20.3 | 19.7 | 1.51 | 0.14 | — | — | 0.3 | 0.5 | 0.5 | 40.0 | 2.2* | present |
| Conventional Ni-based alloy plate | 5 | 21.5 | 13.2 | — | 4.11 | — | — | — | 3.03 | — | 33.8 | 3.3 | none |
| | 6 | 30.3 | 5.14 | 0.21 | 15.1 | — | — | 0.52 | 2.53 | — | 35.44 | 4.61 | none |
| | 7 | 8.4 | 25.2 | — | 1.62 | — | — | — | — | — | 33.6 | — | none |
| | 8 | — | 28.1 | — | 1.95 | — | — | — | — | — | 28.1 | — | none |
| | 9 | 30.4 | 19.6 | — | — | — | — | — | — | — | 50.0 | — | present |

(Note: The values with an * are out of the range of the invention or preferred range.)

TABLE 47

| type | | corrosion speed by soaking in sulfuric acid liquid (mm/year) | | | | | | |
|---|---|---|---|---|---|---|---|---|
| | | 60% $H_2SO_4$ | 80% $H_2SO_4$ | 60% $H_2SO_4$ with active carbon | 80% $H_2SO_4$ with active carbon | 60% $H_2SO_4$ + 100 ppm HCl | 60% $H_2SO_4$ + 10 ppm $HNO_3$ | 60% $H_2SO_4$ + 400 ppm $Fe^{3+}$ |
| Ni-based alloy plate of the present invention | 145 | 0.07 | 0.08 | 0.64 | 0.86 | 0.12 | 0.156 | 0.280 |
| | 146 | 0.04 | 0.10 | 0.89 | 0.92 | 0.06 | 0.122 | 0.255 |
| | 147 | 0.19 | 0.38 | 0.43 | 0.54 | 0.23 | 0.304 | 0.539 |
| | 148 | 0.24 | 0.15 | 0.69 | 0.52 | 0.29 | 0.462 | 0.635 |
| | 149 | 0.09 | 0.16 | 0.85 | 0.83 | 0.16 | 0.205 | 0.725 |
| | 150 | 0.13 | 0.21 | 0.94 | 0.91 | 0.18 | 0.311 | 0.413 |
| | 151 | 0.15 | 0.74 | 0.22 | 0.68 | 0.21 | 0.434 | 0.487 |
| | 152 | 0.16 | 0.23 | 0.40 | 0.49 | 0.22 | 0.355 | 0.459 |
| | 153 | 0.06 | 0.24 | 0.59 | 0.87 | 0.11 | 0.172 | 0.576 |
| | 154 | 0.07 | 0.08 | 0.36 | 0.73 | 0.15 | 0.195 | 0.225 |

TABLE 48

| type | | corrosion speed by soaking in sulfuric acid liquid (mm/year) | | | | | | |
|---|---|---|---|---|---|---|---|---|
| | | 60% $H_2SO_4$ | 80% $H_2SO_4$ | 60% $H_2SO_4$ with active carbon | 80% $H_2SO_4$ with active carbon | 60% $H_2SO_4$ + 100 ppm HCl | 60% $H_2SO_4$ + 10 ppm $HNO_3$ | 60% $H_2SO_4$ + 400 ppm $Fe^{3+}$ |
| Ni-based alloy plate of the present invention | 155 | 0.31 | 0.41 | 0.55 | 0.72 | 0.37 | 0.44 | 0.76 |
| | 156 | 0.44 | 0.52 | 0.63 | 0.88 | 0.46 | 0.55 | 0.87 |
| | 157 | 0.21 | 0.43 | 0.61 | 0.71 | 0.24 | 0.38 | 0.75 |
| | 158 | 0.06 | 0.09 | 0.73 | 0.84 | 0.09 | 0.17 | 0.38 |
| | 159 | 0.24 | 0.35 | 0.51 | 0.63 | 0.27 | 0.36 | 0.43 |
| | 160 | 0.23 | 0.47 | 0.54 | 0.58 | 0.29 | 0.44 | 0.66 |
| | 161 | 0.14 | 0.69 | 0.34 | 0.49 | 0.21 | 0.48 | 0.52 |
| | 162 | 0.09 | 0.28 | 0.57 | 0.82 | 0.18 | 0.19 | 0.59 |
| | 163 | 0.33 | 0.39 | 0.54 | 0.76 | 0.37 | 0.46 | 0.71 |
| | 164 | 0.05 | 0.21 | 0.61 | 0.84 | 0.11 | 0.17 | 0.55 |
| | 165 | 0.12 | 0.29 | 0.55 | 0.61 | 0.17 | 0.34 | 0.51 |
| | 166 | 0.14 | 0.31 | 0.57 | 0.58 | 0.19 | 0.27 | 0.48 |
| | 167 | 0.15 | 0.34 | 0.51 | 0.66 | 0.24 | 0.31 | 0.49 |

TABLE 49

| type | | corrosion speed by soaking in sulfuric acid liquid (mm/year) | | | | | | |
|---|---|---|---|---|---|---|---|---|
| | | 60% $H_2SO_4$ | 80% $H_2SO_4$ | 60% $H_2SO_4$ with active carbon | 80% $H_2SO_4$ with active carbon | 60% $H_2SO_4$ + 100 ppm HCl | 60% $H_2SO_4$ + 10 ppm $HNO_3$ | 60% $H_2SO_4$ + 400 ppm $Fe^{3+}$ |
| Comparative Ni-based alloy plate | 28 | 0.20 | 0.83 | 0.63 | 0.92 | 0.24 | 0.51 | 0.88 |
| | 29 | 0.12 | 0.09 | 16.8 | 1.33 | 0.19 | 0.39 | 0.52 |
| | 30 | 0.23 | 0.32 | 2.11 | 2.03 | 0.31 | 1.13 | 0.93 |
| | 31 | 0.94 | 1.27 | 11.7 | 1.04 | 1.04 | 1.81 | 1.95 |
| | 32 | 0.76 | 0.56 | 24.8 | 1.76 | 0.88 | 0.63 | 2.27 |
| | 33 | 0.32 | 0.86 | 1.91 | 1.33 | 0.34 | 0.59 | 0.98 |
| | 34 | 0.21 | 0.42 | 0.61 | 0.63 | 0.27 | 0.29 | 0.66 |
| | 35 | 0.52 | 0.44 | 22.3 | 0.92 | 0.63 | 1.45 | 1.45 |
| | 36 | 0.08 | 0.12 | 37 | 0.81 | 0.14 | 0.24 | 0.29 |
| | 37 | 0.28 | 0.19 | 71 | 0.63 | 0.36 | 0.46 | 0.65 |

TABLE 50

| type | | corrosion speed by soaking in sulfuric acid liquid (mm/year) | | | | | | |
|---|---|---|---|---|---|---|---|---|
| | | 60% $H_2SO_4$ | 80% $H_2SO_4$ | 60% $H_2SO_4$ with active carbon | 80% $H_2SO_4$ with active carbon | 60% $H_2SO_4$ + 100 ppm HCl | 60% $H_2SO_4$ + 10 ppm $HNO_3$ | 60% $H_2SO_4$ + 400 ppm $Fe^{3+}$ |
| Comparative Ni-based alloy plate | 38 | 0.44 | 0.32 | 9.34 | 0.81 | 0.53 | 0.93 | 1.18 |
| | 39 | 0.84 | 0.66 | 10.3 | 2.24 | 0.92 | 1.72 | 2.03 |
| | 40 | 0.64 | 1.82 | 18.1 | 2.21 | 0.71 | 0.95 | 1.76 |
| | 41 | 0.24 | 0.71 | 0.76 | 0.98 | 0.32 | 0.55 | 0.81 |
| | 42 | 0.58 | 0.76 | 3.67 | 2.15 | 0.64 | 1.16 | 1.77 |
| | 43 | 0.22 | 0.08 | 0.52 | 0.56 | — | — | — |
| Conventional Ni-based alloy plate | 5 | 3.21 | 10.3 | 15.2 | 2.45 | 3.24 | 3.10 | 2.63 |
| | 6 | 0.92 | 16.2 | 32.3 | 0.15 | 1.07 | 1.15 | 3.35 |
| | 7 | 0.06 | 0.03 | 15.3 | 1.60 | 0.14 | 0.87 | 1.73 |
| | 8 | 0.02 | 0.01 | 20.2 | 0.76 | 0.04 | 0.53 | 0.63 |
| | 9 | 31.4 | 8.23 | 0.12 | 0.32 | — | 30.2 | 6.65 |

What is claimed is:

1. A nickel-based alloy consisting of:

15 to 35 weight % of chromium;

17 to 23 weight % of molybdenum;

wherein the sum of chromium plus molybdenum is no greater than 43 weight %;

1.3 to 3.4 weight % of tantalum;

no greater than 0.1 weight % of nitrogen; no greater than 0.3 weight % of magnesium, no greater than 3 weight % of manganese, no greater than 0.3 weight % of silicon, no greater than 0.1 weight % of carbon, no greater than 6 weight % of iron, no greater than 0.1 weight % of boron, no greater than 0.1 weight % of zirconium, no greater than 0.01 weight % of calcium, no greater than 1 weight % of niobium, no greater than 4 weight % of tungsten, no greater than 4 weight % of copper, no greater than 0.8 weight % of titanium , no greater than 0.8 weight % of aluminum, no greater than 5 weight % of cobalt, no greater than 0.5 weight % of vanadium, no greater than 2 weight % of hafnium, no greater than 3 weight % of rhenium, no greater than 1 weight % of osmium, no greater than 1 weight % of platinum, no greater than 1 weight % of ruthenium, no greater than 1 weight % of palladium, no greater than 0.1 weight % of lanthanum, no greater than 0.1 weight % of cerium, and no greater than 0.1 weight % of yttrium; and balance nickel and unavoidable impurities.

2. A nickel-based alloy according to claim 1, wherein nitrogen is contained in an amount of no less than 0.0001 weight %.

3. A nickel-based alloy according to claim 2, wherein magnesium is contained in an amount of no less than 0.0001 weight %.

4. A nickel-based alloy according to claim 2, wherein iron is contained in an amount of no less than 0.001 weight %.

5. A nickel-based alloy according to claim 2, wherein at least one of boron, zirconium or calcium is contained in a respective amount of no less than 0.001 weight %.

6. A nickel-based alloy according to claim 2, wherein at least one of niobium, tungsten or copper is contained in a respective amount of no less than 0.1 weight %.

7. A nickel-based alloy according to claim 2, wherein at least one of no less than 0.05 weight % of titanium, no less than 0.01 weight % of aluminum, no less than 0.1 weight % of cobalt, or no less than 0.1 weight % of vanadium is contained.

8. A nickel-based alloy according to claim 2, wherein at least one of no less than 0.1 weight % of hafnium or no less than 0.01 weight % of rhenium is contained.

9. A nickel-based alloy according to claim 2, wherein at least one of osmium, platinum, ruthenium or palladium is contained in a respective amount of no less than 0.01 weight %.

10. A nickel-based alloy according to claim 2, wherein at least one of lanthanum, cerium, or yttrium is contained in a respective amount of no less than 0.01 weight %.

11. A nickel-based alloy consisting of:

17 to 22 weight % of chromium;

19 to 23 weight % of molybdenum;

wherein the sum of chromium plus molybdenum is 38–43 weight %;

1.3–3.4 weight % of tantalum;

no greater than 0.1 weight % of nitrogen; no greater than 0.3 weight % of magnesium, no greater than 3 weight % of manganese, no greater than 0.3 weight % of silicon, no greater than 0.1 weight % of carbon, 0.01 to 4.0 weight % of iron, no greater than 0.01 weight % boron, no greater than 0.01 weight % of zirconium, no greater than 0.01 weight % of calcium, no greater than 0.5 weight % of niobium, no greater than 2 weight of tungsten, no greater than 2 weight % of copper, no greater than 0.8 weight % of titanium, no greater than 0.8 weight % of aluminum, no greater than 5 weight % of cobalt, no greater than 0.5 weight % of vanadium, no greater than 2 weight % of hafnium, no greater than 3 weight % of rhenium, no greater than 1 weight % of osmium, no greater than 1 weight % of platinum, no greater than 1 weight % of ruthenium, no greater than 1 weight % of palladium, no greater than 0.1 weight % of lanthanum, no greater than 0.1 weight % of cerium, and no greater than 0.1 weight % of yttrium; and balance nickel and unavoidable impurities, wherein $(4\times\text{niobium}+\text{tungsten}+\text{copper})\leqq 2$ weight %.

12. A nickel-based alloy according to claim 11, wherein at least one of zirconium or boron is contained in a respective amount of no less than 0.001 weight %.

13. A nickel-based alloy according to claim 12, wherein at least one of niobium, tungsten or copper is contained in a respective amount of no less than 0.1 weight %.

* * * * *